US006394546B1

(12) United States Patent
Knoblock et al.

(10) Patent No.: US 6,394,546 B1
(45) Date of Patent: May 28, 2002

(54) LUMBAR DEVICE

(75) Inventors: Glenn A. Knoblock, deceased, late of Grand Rapids, MI (US); by Daryl Knoblock, legal representative, Fort Collins, CO (US); Arnold B. Dammermann, Winona, MN (US); Larry DeKraker, Holland, MI (US); Kevin A. Ekdahl, Chicago, IL (US); Kurt R. Heidmann, Grand Rapids, MI (US); Gardner J. Klaasen, II, Ada, MI (US); James A. Perkins, Alto, MI (US); Gordon J. Peterson, Rockford, MI (US); Edward H. Punches; Charles P. Roossien, both of Wyoming, MI (US); David S. Teppo, East Grand Rapids, MI (US); Michael J. Yancharas, Comstock Park, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/705,691

(22) Filed: Nov. 3, 2000

Related U.S. Application Data

(63) Continuation-in-part of application No. 09/491,975, filed on Jan. 27, 2000, which is a continuation of application No. 09/386,668, filed on Aug. 31, 1999, now Pat. No. 6,116,695, which is a division of application No. 08/957,506, filed on Oct. 24, 1997, now Pat. No. 6,086,153, which is a continuation of application No. 09/294,751, filed on Apr. 19, 1999, now Pat. No. 6,220,661, which is a continuation of application No. 09/564,934, filed on May 4, 2000.

(51) Int. Cl.[7] ..... A47C 3/025

(52) U.S. Cl. ..... 297/284.7; 297/284.4

(58) Field of Search ..... 297/284.1, 284.4, 297/284.7, 284.5; 29/428

(56) References Cited

U.S. PATENT DOCUMENTS

| | | | | |
|---|---|---|---|---|
| 1,228,771 | A | | 6/1917 | Hanger |
| 2,550,831 | A | | 5/1951 | Lingenfelter |
| 2,756,809 | A | | 7/1956 | Endresen |
| 2,831,533 | A | * | 4/1958 | Pasquarelli |
| 2,894,565 | A | | 7/1959 | Conner |
| 2,991,124 | A | | 7/1961 | Schwarz |
| 3,095,188 | A | | 6/1963 | Giese |
| 3,241,879 | A | | 3/1966 | Castello et al. |
| 3,463,544 | A | | 8/1969 | Froelich |
| 4,148,522 | A | | 4/1979 | Sakurada et al. |
| 4,156,544 | A | | 5/1979 | Swenson et al. |
| 4,182,533 | A | | 1/1980 | Arndt et al. |
| 4,239,282 | A | | 12/1980 | White |
| 4,296,965 | A | | 10/1981 | Sakurada et al. |
| 4,502,728 | A | | 3/1985 | Sheldon et al. |

(List continued on next page.)

FOREIGN PATENT DOCUMENTS

| | | |
|---|---|---|
| DE | 3341389 A1 | 5/1985 |
| WO | WO9325121 | 12/1993 |

*Primary Examiner*—Milton Nelson, Jr.
(74) *Attorney, Agent, or Firm*—Price Heneveld Cooper DeWitt & Litton

(57) ABSTRACT

A seating unit includes a flexible back including a concavely-shaped lumbar region, and a tensioned cover stretched over the concavely-shaped lumbar region. A lumbar device is fit between the front surface and the covering, with a tension of the covering biasing the lumbar device against the lumbar region and resulting in a frictional force retaining the lumbar device in a selected vertical position. In one form, the lumbar device is sufficiently stiff to maintain its vertical cross sectional shape and to change a shape of the lumbar region as the lumbar device is adjusted vertically, but is sufficiently flexible to conform to a horizontal shape of the lumbar region as a seated user moves and twists while seated in the seating unit.

41 Claims, 21 Drawing Sheets

U.S. PATENT DOCUMENTS 4,536,030 A 8/1985 Sakurada et al.
4,541,670 A 9/1985 Morgenstern et al.
4,565,406 A 1/1986 Suzuki
4,588,172 A 5/1986 Fourrey et al.
4,632,454 A 12/1986 Naert
4,634,176 A 1/1987 Scott
4,634,178 A 1/1987 Carney
4,676,550 A 6/1987 Neve De Mevergnies
4,715,653 A 12/1987 Hattori et al.
4,722,569 A 2/1988 Morgenstern et al.
4,730,871 A 3/1988 Sheldon
4,746,168 A 5/1988 Bracesco
4,810,034 A * 3/1989 Beier
4,811,986 A 3/1989 Hattori et al.
4,834,455 A 5/1989 Proctor
4,950,032 A 8/1990 Nagasaka
5,007,677 A 4/1991 Ozawa et al.
5,022,709 A 6/1991 Marchino
5,050,930 A 9/1991 Schuster et al.
5,112,106 A 5/1992 Asbjornsen et al.
5,120,109 A 6/1992 Rangoni
5,217,278 A 6/1993 Harrison et al.
5,249,839 A 10/1993 Faiks et al.
5,299,851 A 4/1994 Lin
5,314,235 A * 5/1994 Johnson
5,335,965 A 8/1994 Sessini
5,385,388 A 1/1995 Faiks et al.
5,403,069 A 4/1995 Inara et al.
5,460,427 A 10/1995 Serber
5,474,358 A 12/1995 Maeyaert
5,482,353 A 1/1996 Lance
5,499,859 A 3/1996 Angell
5,505,520 A 4/1996 Frusti et al.
5,507,559 A 4/1996 Lance
5,518,294 A 5/1996 Ligon, Sr. et al.
5,567,010 A 10/1996 Sparks
5,567,011 A 10/1996 Sessini
5,630,650 A 5/1997 Peterson et al.
5,641,205 A 6/1997 Schmidt
5,658,047 A 8/1997 Ratza et al.
5,685,606 A 11/1997 Lance
5,711,575 A 1/1998 Hand et al.
5,716,098 A 2/1998 Lance
5,722,725 A 3/1998 McNaughton
5,769,490 A 6/1998 Falzon
5,788,328 A 8/1998 Lance
5,797,652 A 8/1998 Darbyshire
5,860,700 A 1/1999 Lance
5,863,095 A 1/1999 Rivard et al.
5,975,632 A 11/1999 Ginat
5,975,634 A 11/1999 Knoblock et al.
6,079,785 A 6/2000 Peterson et al.

* cited by examiner

LUMBAR DEVICE

RELATED APPLICATIONS

The present application is a continuation-in-part application of co-assigned, copending U.S. patent application Ser. No. 09/491,975, filed Jan. 27, 2000, entitled Back for Seating Unit, which is a continuation of co-assigned, U.S. patent application Ser. No. 09/386,668, filed Aug. 31, 1999, entitled Chair Control Having An Adjustable Energy Mechanism, (now U.S. Pat. No. 6,116,695, issued Sep. 12, 2000) which is a divisional application of co-assigned, U.S. patent application Ser. No. 08/957,506, filed Oct. 24, 1997, entitled Chair with Reclineable Back and Adjustable Energy Mechanism (now U.S. Pat. No. 6,086,153, issued Jul. 11, 2000). The present application is further a continuing application of co-assigned, U.S. patent application Ser. No. 09/294,751, filed Apr. 19, 1999, entitled Chair Back and Method of Assembly (now U.S. Pat. No. 6,220,661, issued Apr. 24, 2001). The present application is still further a continuing application of co-assigned, copending U.S. patent application Ser. No. 09/564,934, filed May 4, 2000, entitled Adjustable Lumbar Support.

This file is also related to the following co-assigned patents and applications. The disclosure of each of these co-assigned patents and applications is incorporated herein by reference in their entirety:

| Title | U.S. Pat. No. /Application No. |
|---|---|
| Chair Including Novel Back Construction | 5,975,634 |
| Chair Having Adjustable Lumbar Support | 6,079,785 |
| Force Adjusting Device | 09/296,004 |
| Chair Having Removable Cover and Cushion | 09/518,276 |
| Back Construction For Chair | 09/565,768 |

BACKGROUND OF THE INVENTION

The present invention concerns a chair having a reclineable back and a vertically adjustable lumbar device for the back.

Manufacturers are becoming increasingly aware that adequate lumbar support is very important to prevent lower back discomfort and distress in humans who are seated for long periods. A problem is that the spinal shape and body shape of humans vary tremendously, such that it is not possible to satisfy all humans with the same shape of back support. Further, the desired level of freeness or force of support in the lumbar area is different for each person and may vary as a seated user performs different tasks and/or reclines in the chair and/or becomes fatigued. In fact, a static lumbar support is undesirable. Instead, it is desirable to provide different lumbar shapes and levels of support over a work day. Accordingly, an adjustable lumbar system is desired that is constructed to vary the shape and force of lumbar support. At the same time, the adjustable lumbar system must be simple and easy to operate, easily reached while seated, mechanically non-complex and low cost, and aesthetically/visually pleasing. Preferably, adjustment of the shape and/or force in the lumbar area should not result in wrinkles in the fabric of the chair, nor unacceptable loose/saggy patches in the fabric. Further, lumbar adjustable devices are wanted that are intuitive to operate and also that are field-installable by the users themselves.

Recently, a new chair has been developed by Steelcase that includes a very flexible back construction adapted to flex significantly in the lumbar region of a seated user's back, and further that is biased in the lumbar region to provide good support to a seated user. The result is a very comfortable back that posturally supports a user as the user moves around in the chair. The back construction not only provides excellent postural support, but it also minimizes shirt pull as a seated user moves between upright and reclined positions. A potential problem is that this back construction flexes to such an extent that it is difficult to eliminate wrinkles and looseness in upholstery covering the back construction in all flexed positions of the back construction, particularly as the back construction is flexed from a deep concave condition where the lumbar region protrudes forwardly, and then is flexed toward a more planar condition where the lumbar region is more aligned with the thoracic and pelvic regions of the back construction. During this flexure, there is a significant change in vertical length along a front surface of the back construction as the back construction is flexed, such that the covering tends to wrinkle and become loose as the lumbar region is flexed toward the more planar condition. The problem is further compounded by the need to have a chair assembly process that minimizes parts, cost, and labor. Still further, the particular new chair design illustrated herein has a novel and attractive rear appearance of the back construction and lumbar adjustment device that, in many circumstances, is desirable not to hide or cover. Thus, an upholstery arrangement is desired that attaches to and is limited primarily to a front surface of the back construction, yet that is secure, durable, and closely retained to the back support structure to prevent looseness and bunching of the covering.

Accordingly, a chair construction solving the aforementioned problems is desired.

SUMMARY OF INVENTION

In one aspect of the present invention, a seating unit includes a flexible back including a non-planar lumbar region, and a tensioned cover stretched over the non-planar lumbar region. A lumbar device is fit between the front surface and the covering, with a tension of the covering biasing the lumbar device against the lumbar region and resulting in a frictional force retaining the lumbar device in a selected vertical position.

In another aspect of the present invention, a back for a seating unit includes a flexible back shell including a non-planar flexible lumbar region, and a cover covering at least a portion of the non-planar flexible lumbar region. A lumbar device fits between the front surface and the covering, the lumbar device being vertically adjustable and being made of a material chosen to generate friction with the lumbar region and with the cover to retain the lumbar device in a selected vertical position.

In another aspect of the present invention, a method includes steps of providing a flexible back including a non-planar lumbar region of a seating unit, providing a cover shaped to cover at least a portion of the non-planar lumbar region, and tensioning the cover over the lumbar region. The method further includes providing a lumbar device, and fitting the lumbar device between the front surface and the covering, with a tension of the covering biasing the lumbar device against the lumbar region and resulting in a frictional force retaining the lumbar device in a selected vertical position.

In yet another aspect of the present invention, a method includes steps of providing a seating unit having a back support with a front surface, covering at least a portion of the front surface with a sheet back covering, and positioning a lumbar device between the front surface of the back support and the portion of the back covering. The method further includes vertically adjusting the lumbar device to a selected height and holding the lumbar device in place with friction between the back support and the back covering.

These and other features, advantages, and objects of the present invention will be further understood and appreciated by those skilled in the art by reference to the following specification, claims and appended drawings.

DETAILED DESCRIPTION OF FIGURES

DETAILED DESCRIPTION OF PREFERRED EMBODIMENTS

Figure 1:
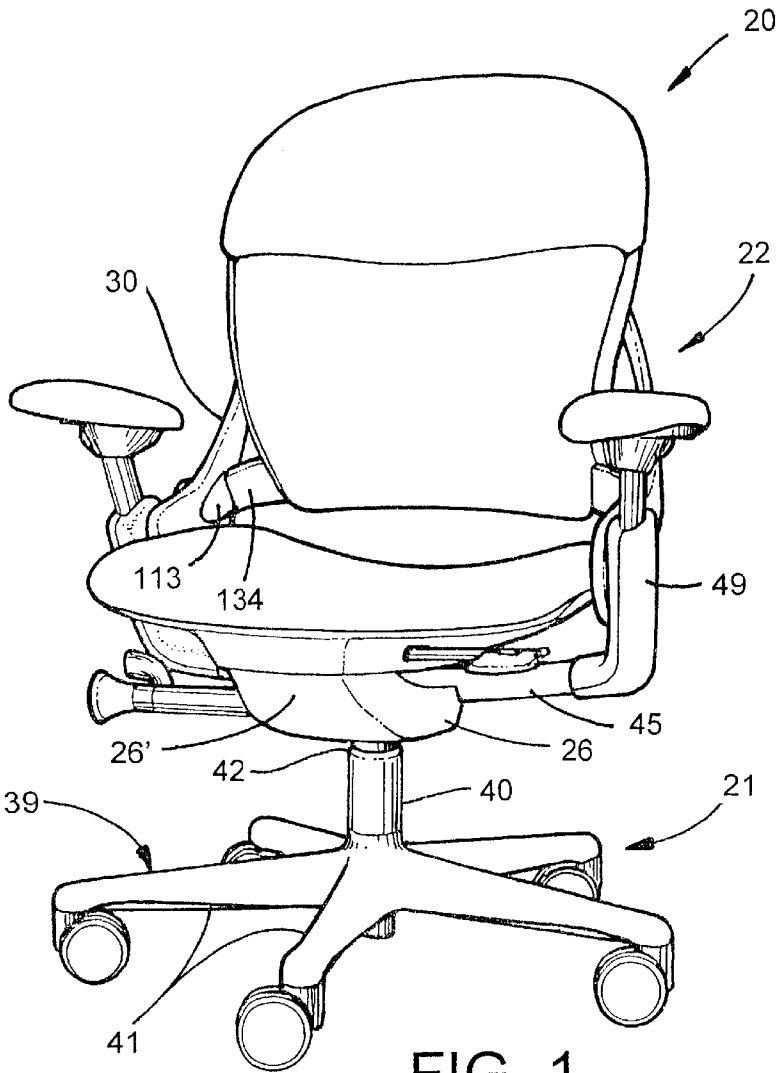
Figure 3:
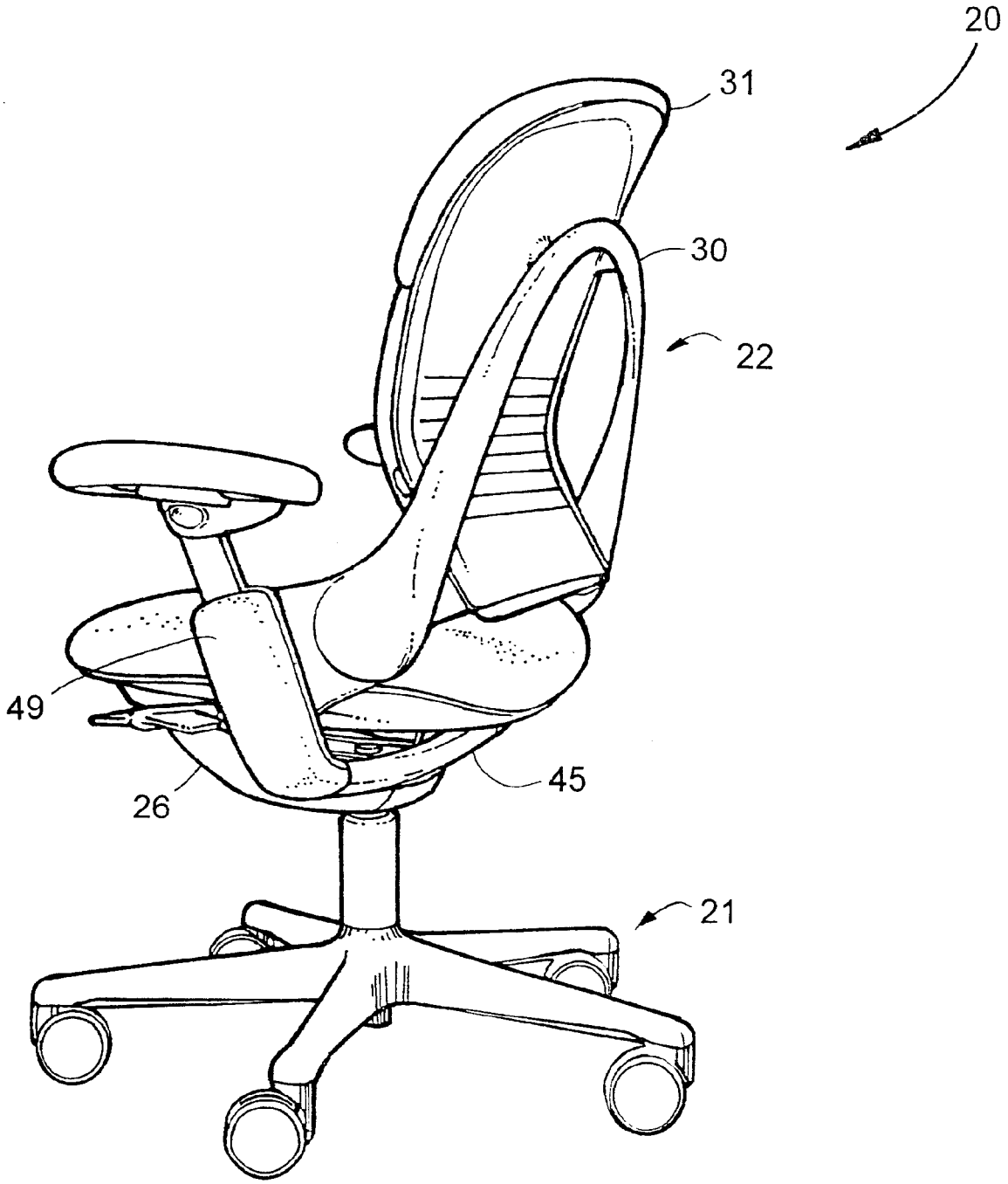

For purposes of description herein, the terms "upper," "lower," "right," "left," "rear," "front," "vertical," "horizontal," and derivatives thereof shall relate to the invention as oriented in FIG. 1 with a person seated in the chair. However, it is to be understood that the invention may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as unnecessarily limiting, unless the claims expressly state otherwise.

Figure 2:
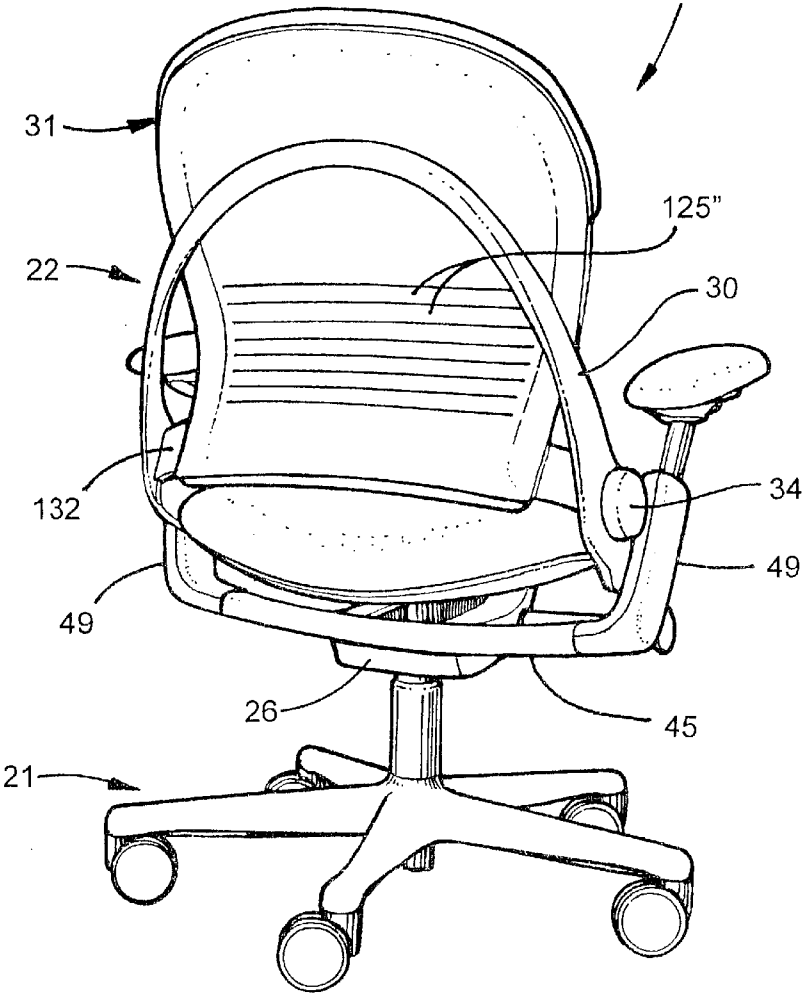
FIGS. 1–3 are front, rear, and side perspective views of a reclineable chair embodying the present invention.

A chair construction 20 (FIGS. 1 and 2) embodying the present invention includes a castored base assembly 21 and a reclineable back assembly 22 pivoted to the base 21 for movement about a stationary back-tilt axis 23 between upright and reclined positions. A seat assembly 24 is pivoted at its rear to the back 22 for movement about a seat-tilt axis 25. Seat-tilt axis 25 is offset rearwardly and downwardly from the back-tilt axis 23, and the seat 24 is slidably supported at its front on the base 21 by linear bearings, such that the seat 24 slides forwardly and its rear rotates downwardly and forwardly with a synchrotilt movement as the back 22 is reclined. The synchronous motion initially moves the back to seat at an angular synchronous ratio of about 2.5:1, and when near the fully reclined position moves the back to seat at an angular synchronous ratio of about 5:1. The seat 24 and back 22 movement during recline provides an exceptionally comfortable ride that makes the seated user feel very stable and secure.

The back assembly 22 includes a back support or back frame 30 (FIG. 4) with structure that defines pivots/axes 23 and 25. A flexible/compliant back shell construction 31 is pivoted to back frame 30 at top connections 32 and bottom connections 33 in a manner providing an exceptionally comfortable and sympathetic back support. A torsionally adjustable lumbar support spring mechanism 34 is provided to bias the back shell 31 forwardly into a forwardly convex curvilinear shape optimally suited for providing good lumbar pressure. A vertically adjustable lumbar support 35 (FIG. 16) is operatively mounted on back shell 31 for vertical movement to provide an optimal shape and pressure location to the front support surface on back 22.

Figure 6:
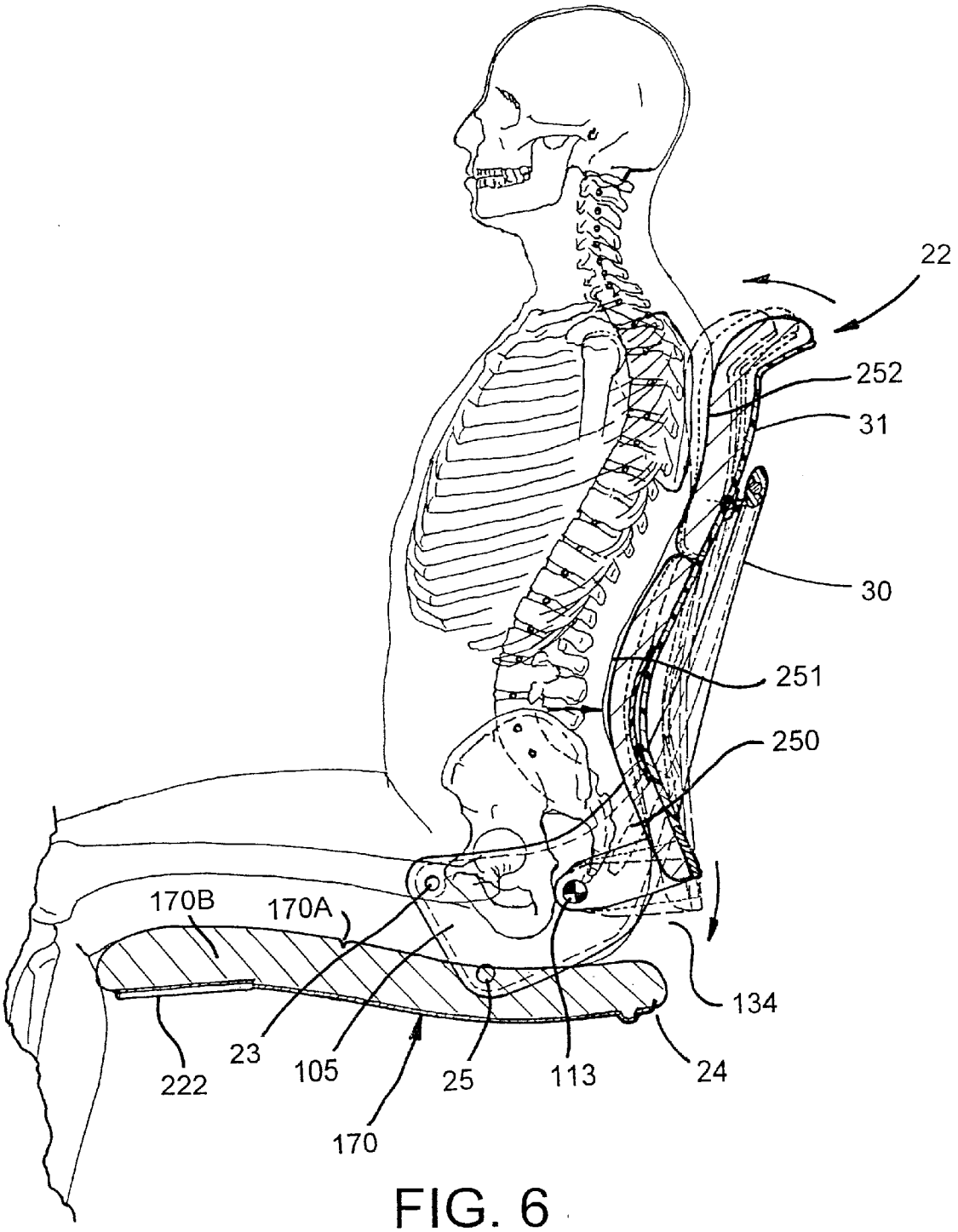
FIG. 6 is a side view of the back assembly shown in FIG. 1 including the back frame and the flexible back shell and including the skeleton and flesh of a seated user, the back shell being shown with a forwardly convex shape in solid lines and being shown in different flexed shapes in dashed and dotted lines.

The back frame 30 and back shell 31 (FIG. 6) form a compliant back support for a seated user that is particularly comfortable and sympathetic to back movements of the seated user, particularly in the lumbar area of the back 22. Adjustment features on the assembly provide further comfort and allow a seated user to customize the chair to meet his/her particular needs and preferences in the upright through reclined positions.

The back frame 30 (FIG. 4) is curvilinearly shaped and forms an arch across the back area of the chair 20. A variety of constructions are contemplated for back frame 30, and accordingly, the present invention should not be improperly limited to only a particular one. For example, the back frame 30 could be entirely metal, plastic, or a combination thereof. Also, the rigid internal reinforcement 102 described below could be tubular, angle iron, or a stamping.

The present back shell system shown in FIGS. 6–9 is compliant and designed to work very sympathetically with the human back. The word "compliant" as used herein is intended to refer to the flexibility of the present back in the lumbar area (see FIG. 6) or a back structure that provides the equivalent of flexibility, and the word "sympathetically" is intended to mean that the back moves in close harmony with a seated user's back and posturally supports the seated user's back as the chair back 22 is reclined and when a seated user flexes his/her lower back. The back shell 31 has three specific regions, as does the human back, those being the thoracic region, the lumbar region, and the pelvic region.

The thoracic "rib cage" region of a human's back is relatively stiff. For this reason, a relatively stiff upper shell portion (FIG. 6) is provided that supports the relatively stiff thoracic (rib cage) region 252 of a seated user. It carries the weight of a user's torso. The upper pivot axis is strategically located directly behind the average user's upper body center of gravity, balancing his/her back weight for good pressure distribution.

The lumbar region 251 of a human's back is more flexible. For this reason, the shell lumbar region of back shell 31 includes two curved, vertical-living hinges 126 at its side edges (FIG. 8) connected by a number of horizontal "cross straps" 125". These straps 125"are separated by widthwise slots 125' allowing the straps to move independently. The slots 125' may have radiused ends or teardrop-shaped ends to reduce concentration of stress. This shell area is configured to comfortably and posturally support the human lumbar region. Both side straps 125" are flexible and able to substantially change radius of curvature from side to side. This shell region automatically changes curvature as a user changes posture, yet maintains a relatively consistent level of support. This allows a user to consciously (or subconsciously) flex his/her back during work, temporarily moving stress off of tiring muscles or spinal disc portions onto different ones. This frequent motion also "pumps" nutrients through the spine, keeping it nourished and more healthy. When a specific user leans against the shell 31, he/she exerts unique relative pressures on the various lumbar "cross straps." This causes the living hinges to flex in a unique way, urging the shell to conform with a user's unique back shape. This provides more uniform support over a larger area of the back improving comfort and diminishing "high pressure points." The cross straps can also flex to better match a user's side-to-side shape. The neutral axis of the human spine is located well inside the back. Correspondingly, the "side straps" are located forward of the central portion of the lumbar region (closer to the spine neutral axis), helping the hell flexure mimnic human back flexure.

The pelvic region 250 (FIG. 6) is rather inflexible on human beings. Accordingly, the lowest portion of the shell 31 is also rather inflexible so that it posturally/mateably supports the inflexible human pelvis. When a user flexes his/her spine rearward, the user's pelvis automatically pivots about his/her hip joint and the skin on his/her back stretches. The lower shell/back frame pivot point is strategically located near but a bit rearward of the human hip joint. Its nearness allows the shell pelvic region to rotate sympathetically with a user's pelvis. By being a bit rearward, however, the lumbar region of the shell stretches (the slots widen) somewhat less than the user's back skin, enough for good sympathetic flexure, but not so much as to stretch or bunch up clothing.

Figure 4:
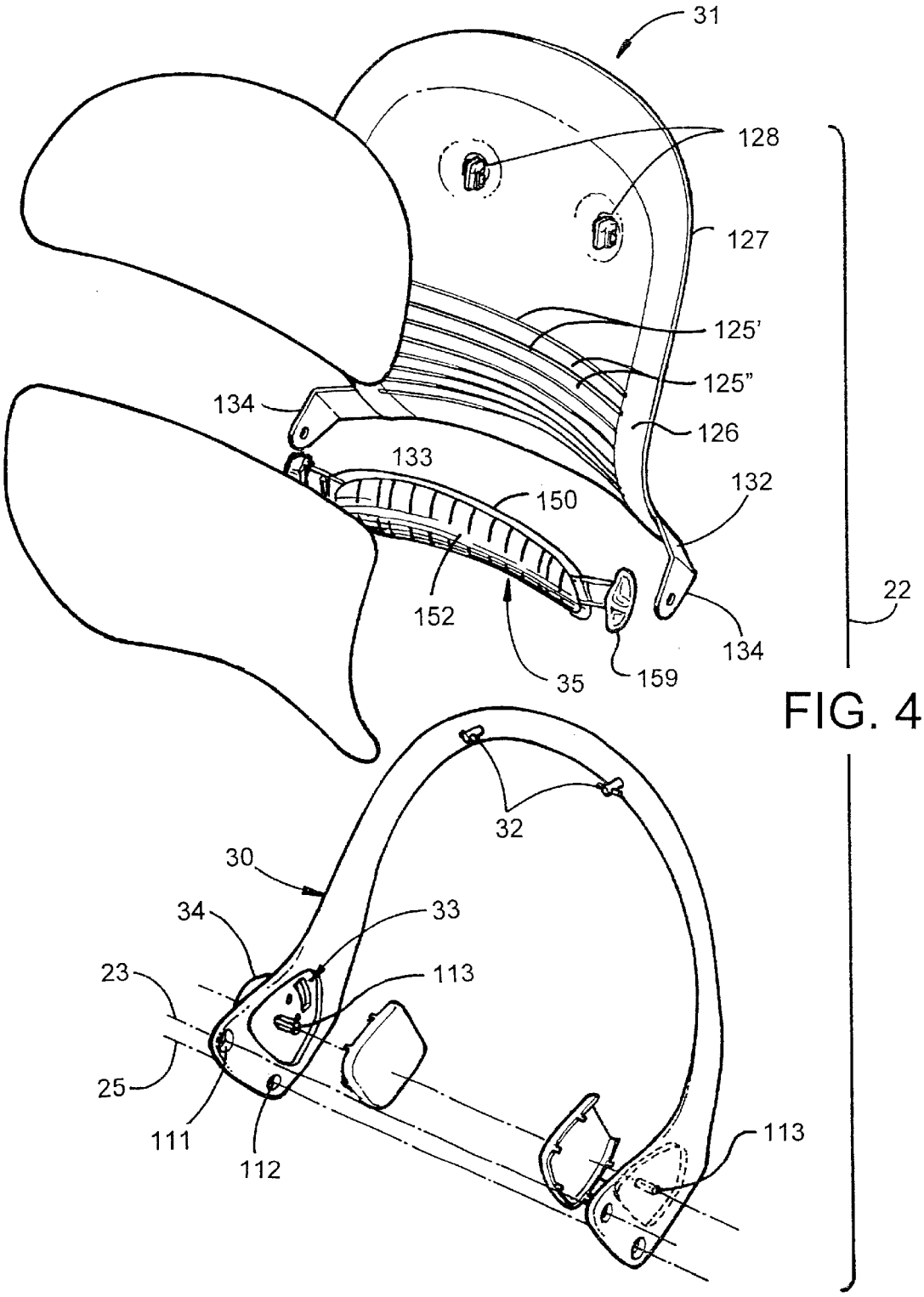
FIG. 4 is an exploded perspective view of an upper portion of the chair shown in FIG. 1.

Specifically, the present back shell construction 31 (FIG. 4) comprises a resiliently flexible molded sheet made from polymeric material such as polypropylene, with top and bottom cushions positioned thereon. The back shell 31 (FIG. 9) includes a plurality of horizontal slots 125' in its lower half that are located generally in the lumbar area of the chair 20. The slots 125' extend substantially across the back shell 31, but terminate at locations spaced from the sides so that resilient vertical bands of material 126 are formed along each edge. The bands of material or side straps 126 are designed to form a naturally forwardly convex shape, but are flexible so that they provide an optimal lumbar support and shape to a seated user. The bands 126 allow the back shell to change shape to conform to a user's back shape in a sympathetic manner, side to side and vertically. A ridge 127 extends along the perimeter of the shell 31. A pair of spaced-apart recesses 128 is formed generally in an upper thoracic area of the back shell 31 on its rearward surface. The recesses 128 each include a T-shaped entrance with the narrow portion 129 (FIG. 8) of the recesses 128 having a width for receiving the stem of the top connector 32 (FIG. 4) on the back frame 30 and with the wider portion 130 (FIG. 8) of the recesses 128 having a width shaped to receive the transverse rod section of the top connector 32 (FIG. 4). The recesses 128 each extend upwardly into the back shell 31 such that opposing flanges 131 (FIG. 8) formed adjacent the narrow portion 129 pivotally capture the rod section of the T-top connector 32 as its stem slides into the narrow portion 129. Ridges in the recesses 128 frictionally positively retain the top connectors 32 and secure the back shell 31 to the back frame 30, yet allow the back shell 31 to pivot about a horizontal axis. This allows for the back shell 31 to flex for optimal lumbar support without undesired restriction.

A belt bracket 132 (FIG. 9) includes an elongated center strip or strap 133 that matches the shape of the bottom edge of the back shell 31 and that is molded into a bottom edge of the back shell 31. The strip 133 can also be an integral part of the back shell or can be attached to back shell 31 with screws, fasteners, adhesive, frictional tabs, insert-molding techniques, or in other ways of attaching known in the art. The strip 133 includes side arms/flanges 134 that extend forwardly from the ends of strip 133 and that include apertures 135. The torsional adjustment lumbar mechanism 34 engages the flanges 134 and pivotally attaches the back shell 31 to the back frame at location 113 (FIG. 4). The torsional adjustment lumbar spring mechanism 34 is adjustable and biases the back shell 31 to a forwardly convex shape to provide optimal lumbar support for a seated user. The torsional adjustment lumbar spring mechanism 34 cooperates with the resilient flexibility of the back shell 31 and with the shape-changing ability of the vertically adjustable lumbar support 35 to provide a highly adjustable and comfortable back support for a seated user.

Figure 5:
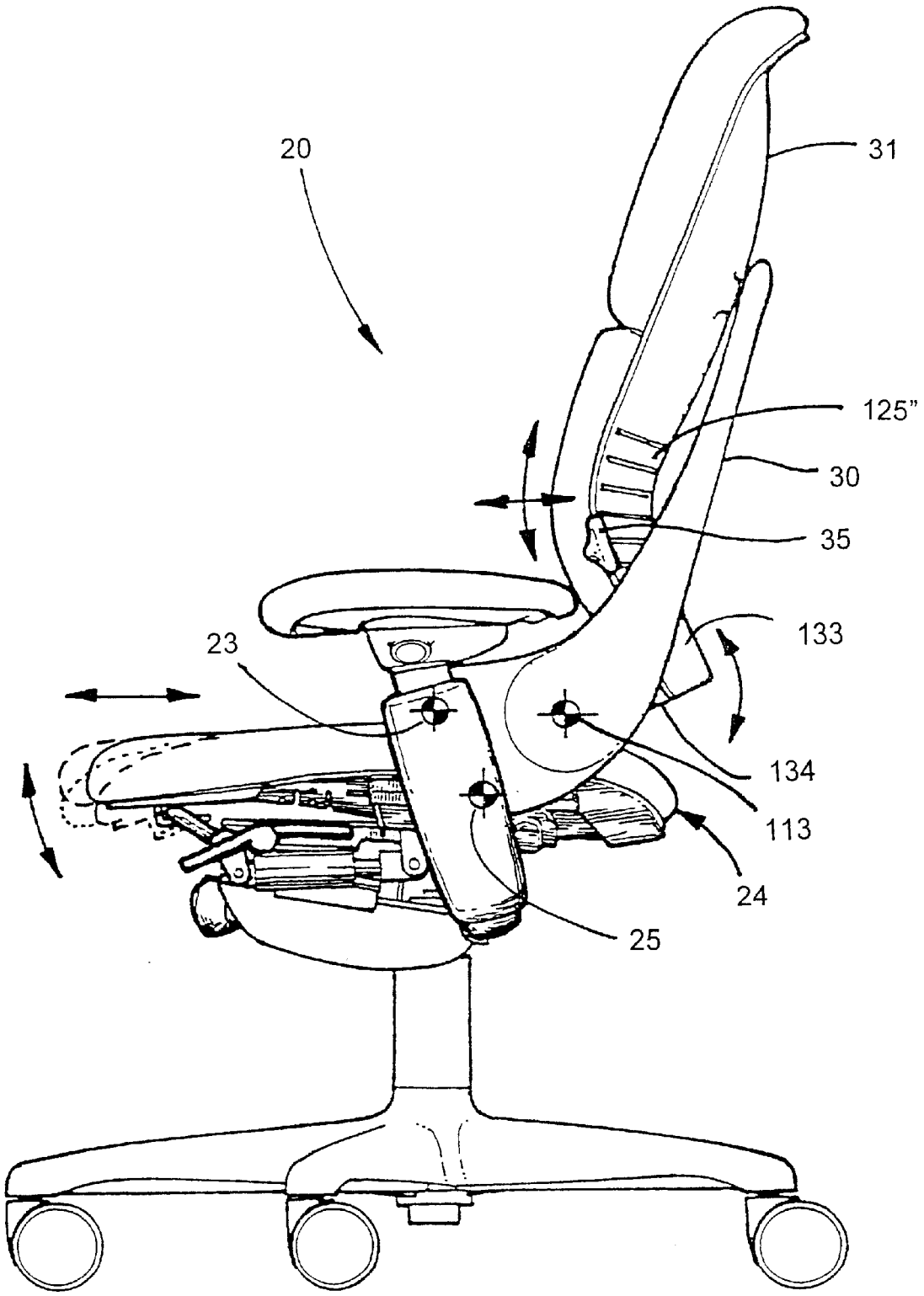
FIG. 5 is a side view of the chair shown in FIG. 1 showing the flexibility and adjustability of the chair when in the upright position.

The pivot location 113 is optimally chosen to be at a rear of the hip bone and somewhat above the seat 24. (See FIGS. 5 and 6.) Optimally, the fore/aft distance from pivot location 113 to strip 133 is approximately equal to the distance from a seated user's hip joint/axis to their lower spine/tail bone region so that the lower back 250 moves very similarly and sympathetically to the way a seated user's lower back moves during flexure about the seated user's hip joint. The location 113 in combination with a length of the forwardly extending side flanges 133 causes back shell 31 to flex in the following sympathetic manner. The pelvic supporting area 250 (FIG. 6) of the back shell construction 31 moves sympathetically rearwardly and downwardly along a path selected to match a person's spine and body movement as a seated user flexes their back and presses their lower back against the back shell construction 31. The lumbar support area 251 simultaneously flexes from a forwardly concave shape toward a more planar shape. The thoracic support area 252 rotates about top connector 107 but does not flex a substantial amount. The total angular rotation of the pelvic and thoracic supporting areas 250 and 252 are much greater than in prior art synchrotilt chairs, which provides substantially increased support. Notably, the back shell construction 31 also flexes in a horizontal plane to provide good postural support for a seated user who twists his/her torso to reach an object. Notably, the back frame 30 is oriented at about a 5° rearward angle from vertical when in the upright position, and rotates to about a 30° rearward angle from vertical when in the fully reclined position. Concurrently, the seat-tilt axis 25 is rearward and at an angle of about 60° below horizontal from the back-tilt axis 23 when the back frame 30 is in the upright position, and pivots to almost vertically below the back-tilt axis 23 when the back frame 30 is in the fully reclined position.

Figure 12:
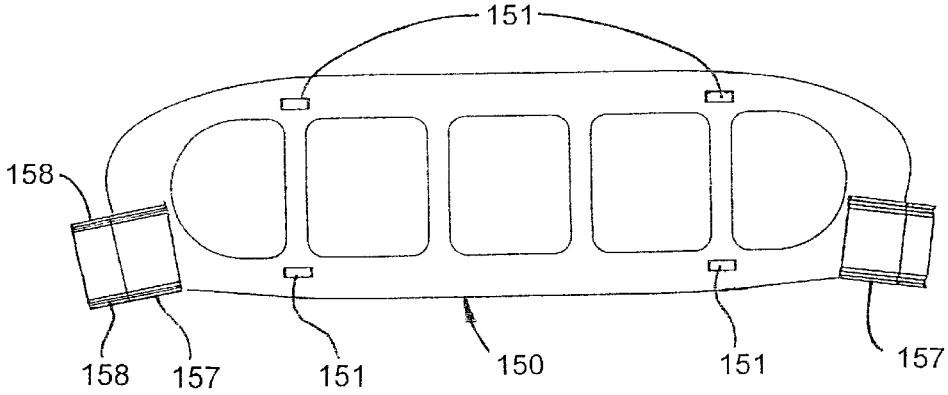
FIG. 12 is a front view of the slide frame of the vertically adjustable lumbar support mechanism shown in FIG. 11.

A vertically adjustable lumbar system 35 (FIG. 9) is provided that includes a slide frame 150 (FIG. 12) that is generally flat and that includes several hooked tabs 151 on its front surface. A concave lumbar support sheet 152 (FIG. 9) of flexible material such as spring steel or flexible plastic includes a plurality of vertical slots that form resilient leaf-spring-like fingers 155 along the top and bottom edges of the sheet 152. The (optional) height adjustable back support sheet 152 is basically a radiused sheet spring that can, with normal back support pressures, deflect until it matches the shape of the back shell beneath it. In doing so, it provides a band of higher force across the back. This provides a user with height-adjustable localized back support, regardless of the flexural shape of the user's back. Thus, it provides the benefits of a traditional lumbar height adjustment without forcing a user into a particular rigid back posture. Further, the fabric or upholstery on the back is always held taunt, such that wrinkles are eliminated. Stretch fabric can also be used to eliminate wrinkles.

A user may also use this device for a second reason, that reason being to more completely adapt the back shell shape to his/her own unique back shape. Especially in the lower lumbar/pelvic region, humans vary dramatically in back shape. Users with more extreme shapes will benefit by sliding the device into regions where their back does not solidly contact the shell. The device will effectively change its shape to exactly "fill in the gap" and provide good support in this area. No other known lumbar height adjuster does this in the manner described below.

Figure 10:
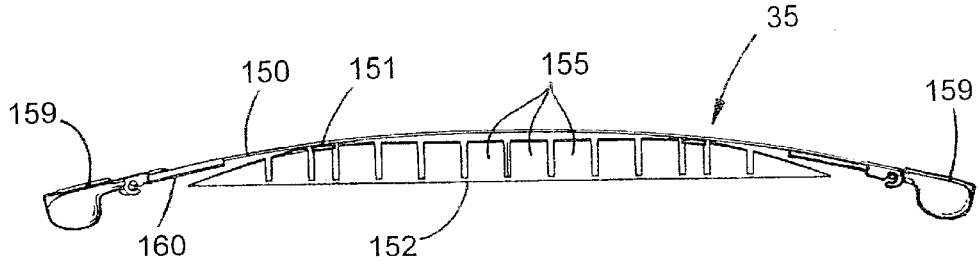
FIGS. 10–11 are front and top views of the vertically adjustable lumbar support mechanism shown in FIG. 9.
Figure 11:
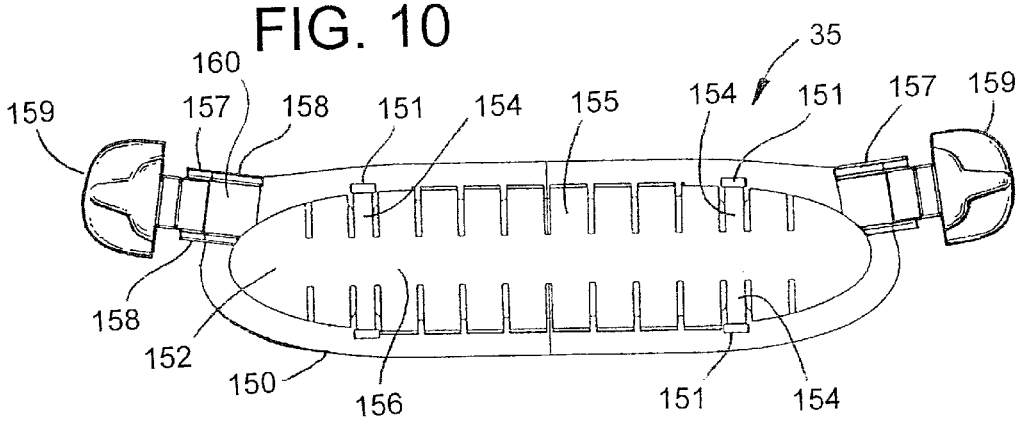
Figure 13:
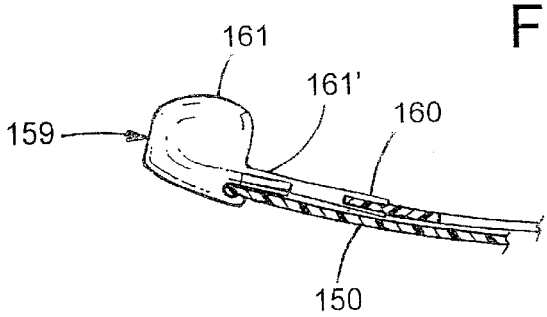
FIG. 13 is a top view, partially in cross section, of the laterally extending handle of the vertically adjustable lumbar support mechanism shown in FIG. 10 and its attachment to the slide member of the lumbar support mechanism.

Four tips 154 on fingers 155 form retention tabs that are particularly adapted to securely engage the hooked tabs 151 to retain the sheet 152 to the slide frame 150. The remaining tips 155 of the fingers 153 slidably engage the slide frame 150 and hold the central portion 156 of the concave sheet forwardly and away from the slide frame 150. The slide frame 150 is vertically adjustable on the back shell 31 (FIG. 9) and is positioned on the back shell 31 between the back shell 31 and the back cushion. Alternatively, it is contemplated that the slide frame 150 could be located between the back cushion and under the upholstery covering the back 22, or even on a front face of the back 22 outside the upholstery sheet covering the back 22. By adjusting the slide vertically, this arrangement allows a seated user to adjust the shape of the lumbar area on the back shell 31, thus providing a high degree of comfort. A laterally extending guide 157 (FIG. 12) is formed at each of the ends of the slide frame 150. The guides 157 include opposing flanges 158 forming inwardly facing grooves. Molded handles 159 (FIG. 13) each include a leg 160 shaped to mateably telescopically engage the guides 157 (FIGS. 10–11). The handles 159 further include a C-shaped lip 160 shaped to snappingly engage a back shell 31. It is contemplated that other means can be provided for guiding the vertical movement of the slide frame 150 on back shell 31, such as a cord, a track molded along but inward of the edge of the back shell, and the like. An enlarged flat end portion 161 of handle 159 extends laterally outwardly from molded handle 159. Notably, the end portion 161 is relatively thin at a location 161' immediately outboard of the lip 160, so that the handle 159 can be extended through a relatively thin slot along the side edge of the back 22 when a cushion and upholstery sheet are attached to the back shell 31.

Figure 7:
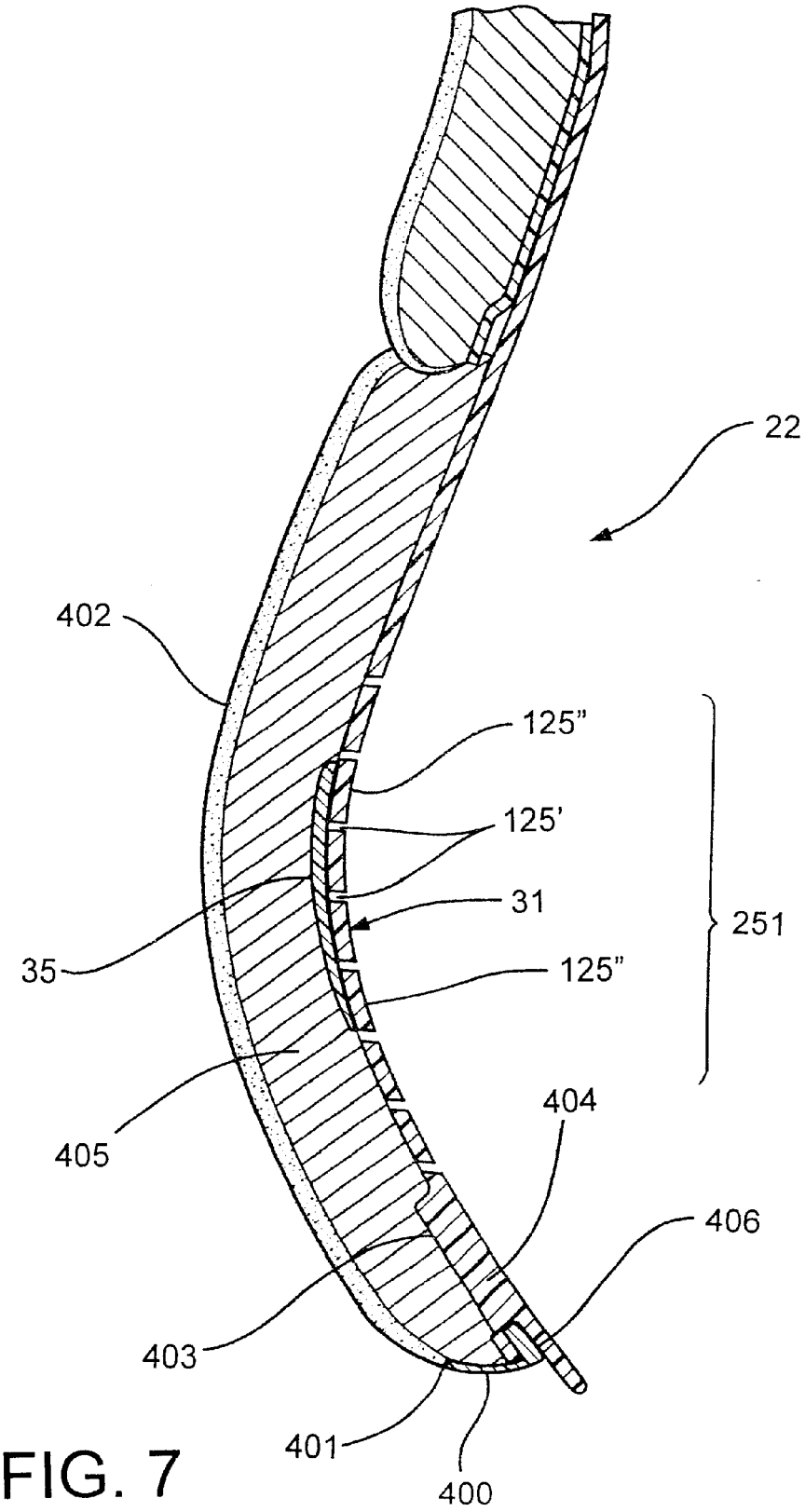
FIG. 7 is a fragmentary cross-sectional side view of the back construction shown in FIG. 6.
Figure 8:
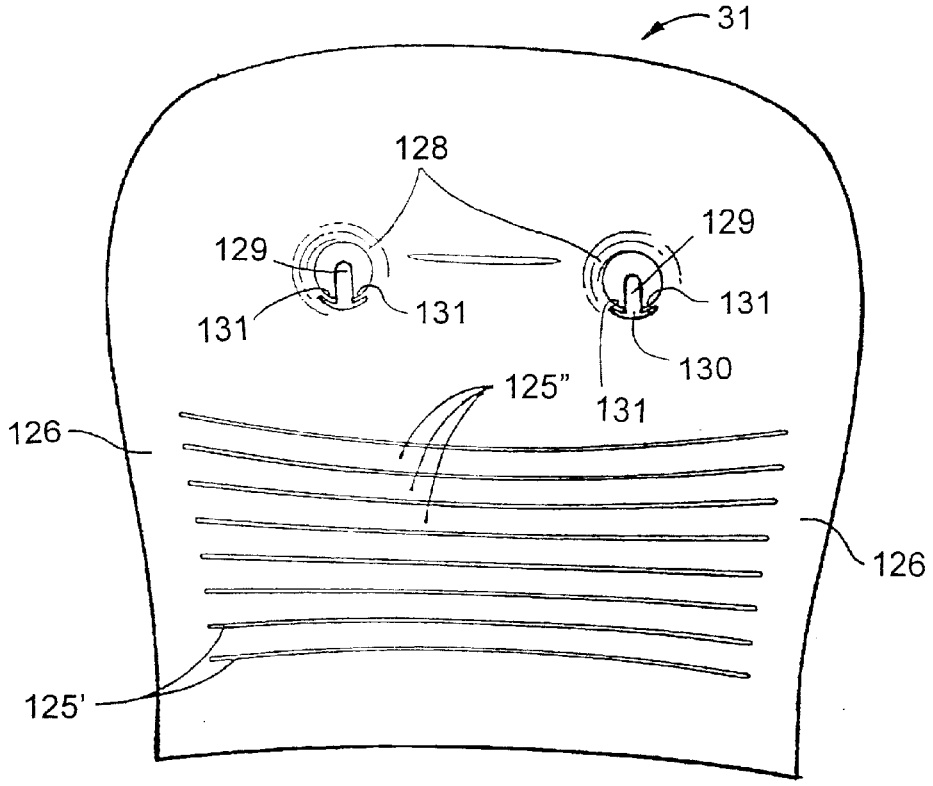
FIG. 8 is a rear view of the back shell shown in FIG. 4.
Figure 9:
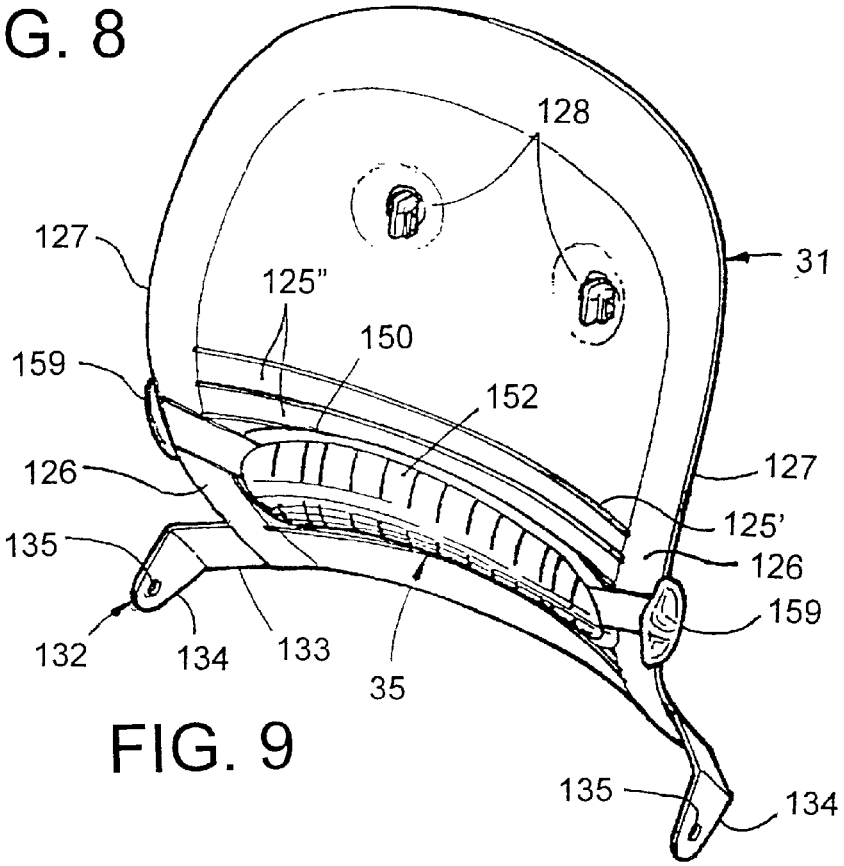
FIG. 9 is a perspective view of the back including the vertically adjustable lumbar support mechanism shown in FIG. 4.

The illustrated back 22 of FIG. 7 includes a novel construction incorporating stretch fabric 400 sewn at location 401 to a lower edge of the upholstery sheet 402 for covering a front of the back 22. The stretch fabric 400 is further sewn into a notch 406 in an extrusion 403 of structural plastic, such as polypropylene or polyethylene. The extrusion 403 is attached to a lower portion 404 of the back shell 31 by secure means, such as snap-in attachment, hook-in attachment, rivets, screws, other mechanical fasteners, or other means for secure attachment (such as insert-molding). The foam cushion 405 of the back 22 and the vertically adjustable lumbar support device 35 are positioned between the sheet 402 and back shell 31. It is contemplated that the stretch fabric will have a stretch rate of at least about 100%, with a recovery of at least 90% upon release. The stretch fabric 400 and sheet 402 are sewn onto the back 22 in a tensioned condition, so that the sheet 402 does not wrinkle or pucker despite the large flexure of the lumbar region 251 toward a planar condition. The stretch fabric 400 is in a low visibility position, but can be colored to the color of the chair if desired. It is noted that covering 402 can be extended to cover the rear of back 22 as well as its front.

MODIFICATION

Figure 15:
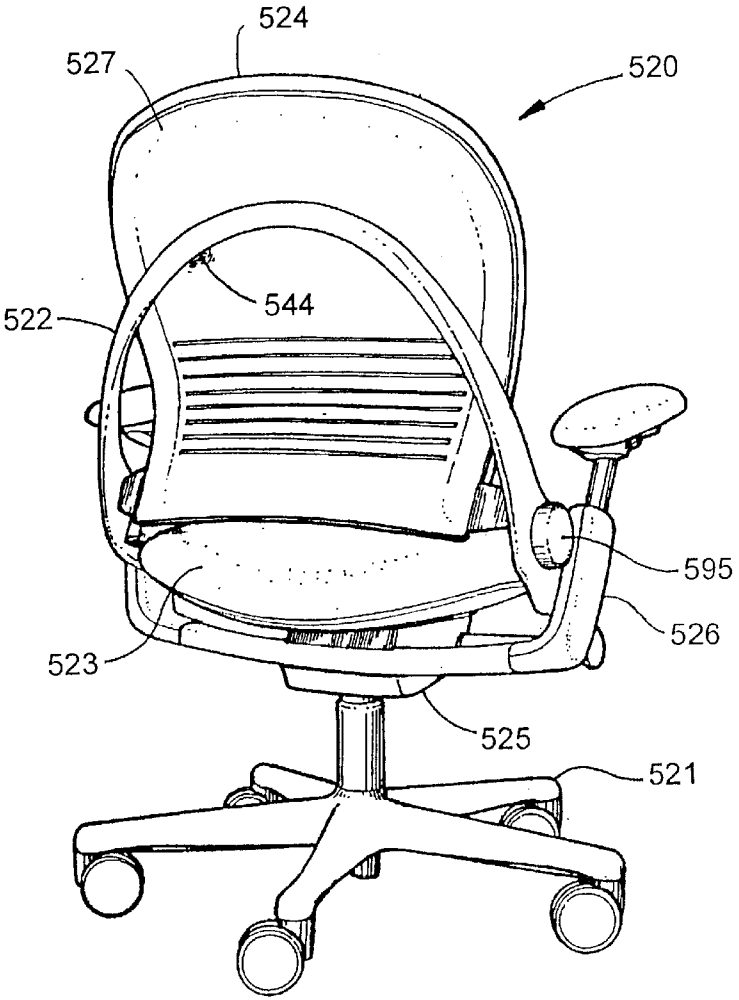
FIGS. 14 and 15 are front and rear perspective views of a modified chair embodying the present invention.
Figure 14:
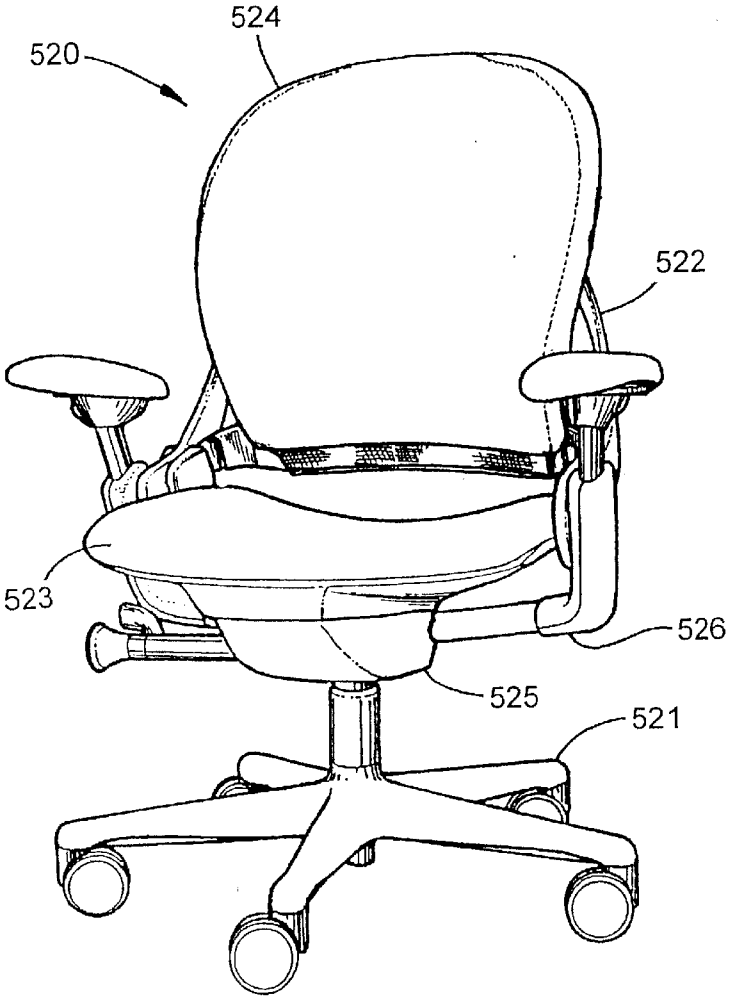
Figure 17:
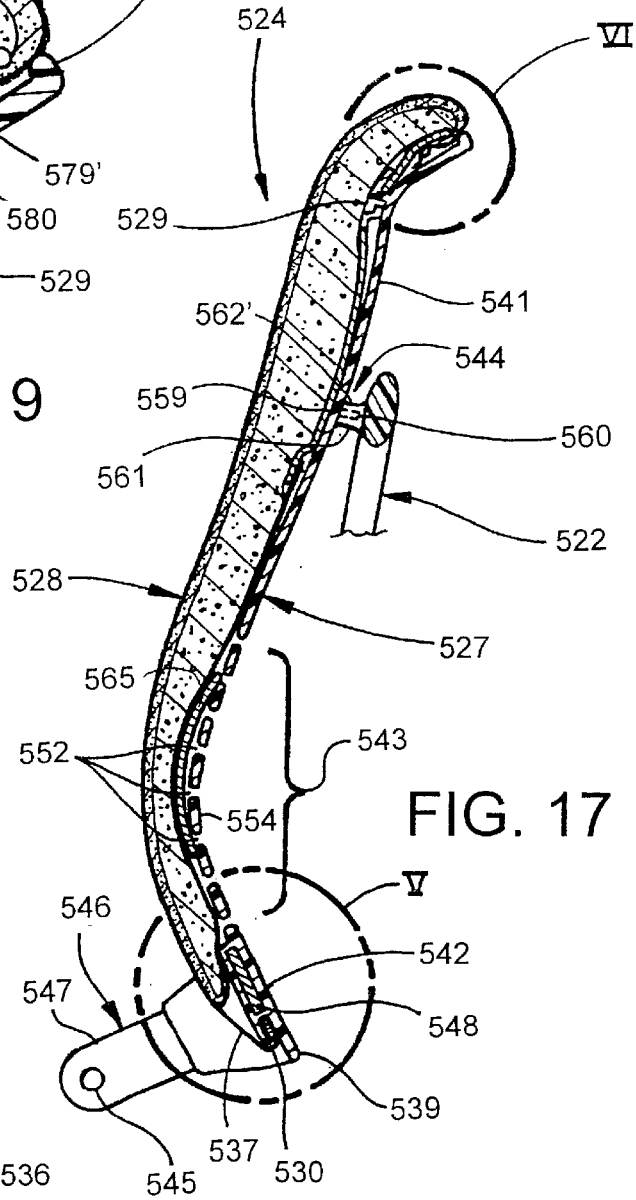
FIG. 17 is a vertical cross-sectional view taken through a center of the back construction shown in FIG. 14.
Figure 18:
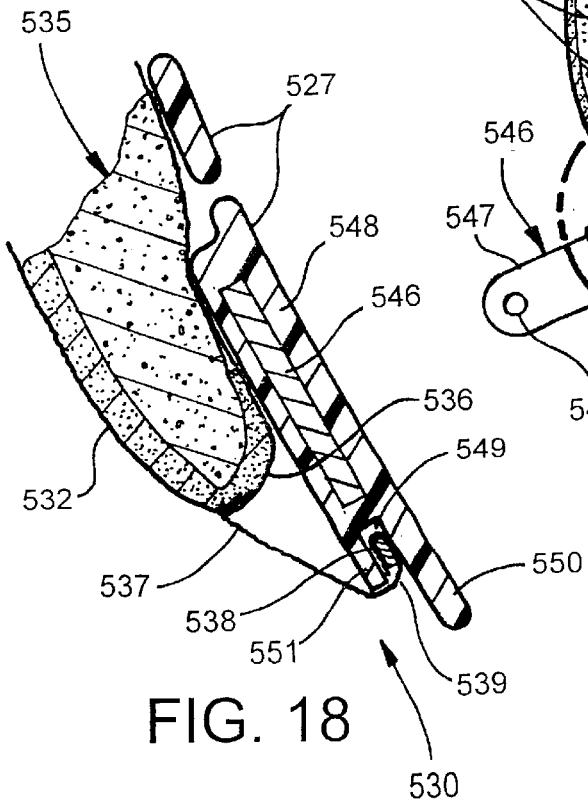
Figure 20:
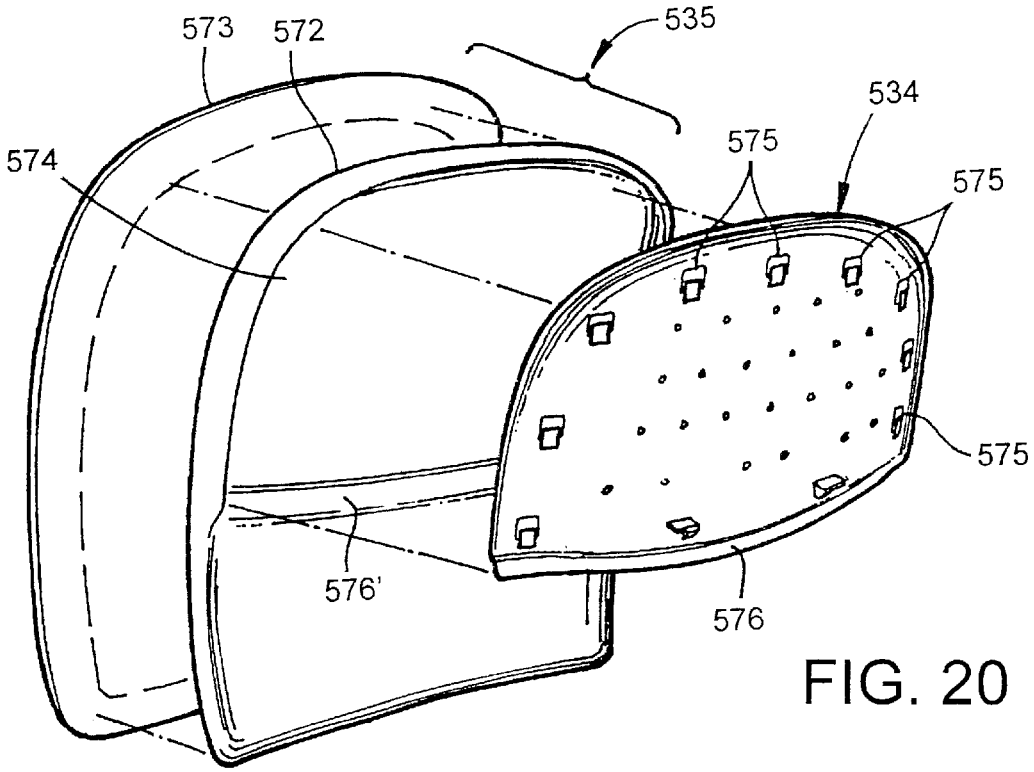
FIG. 20 is an exploded perspective view of the stiffened cushion subassembly shown in FIG. 16.
Figure 21:
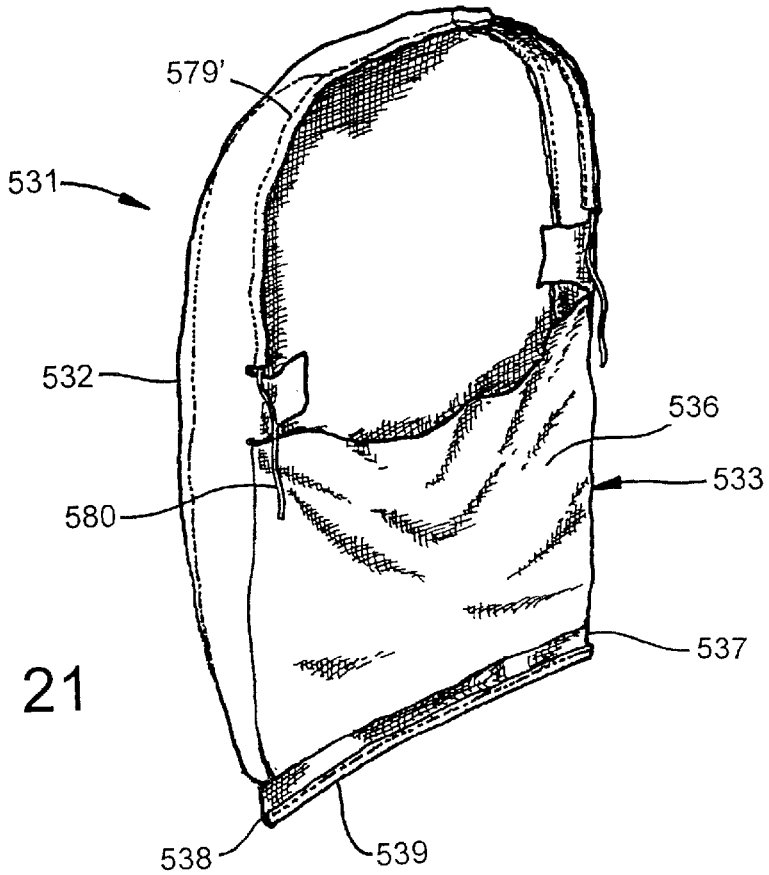
FIG. 21 is a perspective view of the cover assembly shown in FIG. 16.

A chair 520 (FIGS. 14–15) embodying the present invention includes a base 521, a back upright or arch-shaped back frame 522, a seat 523, and a back construction 524. The base 521 includes a control housing 525, with fixed side support structures 526 extending laterally and upwardly from the control housing 525. The back upright 522 is movable between an upright position and a reclined position. The back construction 524 (FIG. 16) includes a back support shell 527 (also referred to as a "back support") attached to the back upright 522 (FIG. 17), and further includes a cushion assembly 528 (FIG. 16) attached to the back support shell 527 with quick-attach hooking top connection 529 and a "zip-lock" type bottom connection 530 (FIG. 18). The cushion assembly 528 includes a cover assembly 531 (FIG. 21) having an upholstery front panel 532 and a rear panel 533 forming a sock that can be inverted and "pulled" upwardly onto a cushion 535 and cushion stiffener 534 (FIG. 20) as the cover assembly 531 is inverted.

The rear panel 533 (FIG. 21) includes a first sheet/fabric section 536 having a one-directional stretch in a vertical direction, and further includes a lower second fabric section 537 having a high-stretch property. The second section 537 hangs downwardly from the front panel 532 and has a strip of stiff material 538 sewn along its lower edge to form the stiffened edge flange 539 noted below, which stiffened edge flange 539 forms part of the bottom connection 530. The stretchable second section 537, in combination with the other structure of top and bottom connections 529 and 530, allow for quick assembly, yet provide for a tensioned cover assembly 531 on the back construction 524 that tends to remain flat and unwrinkled, even with considerable flexure of the back construction 524 in the lumbar region of the back construction 524.

Figure 16:
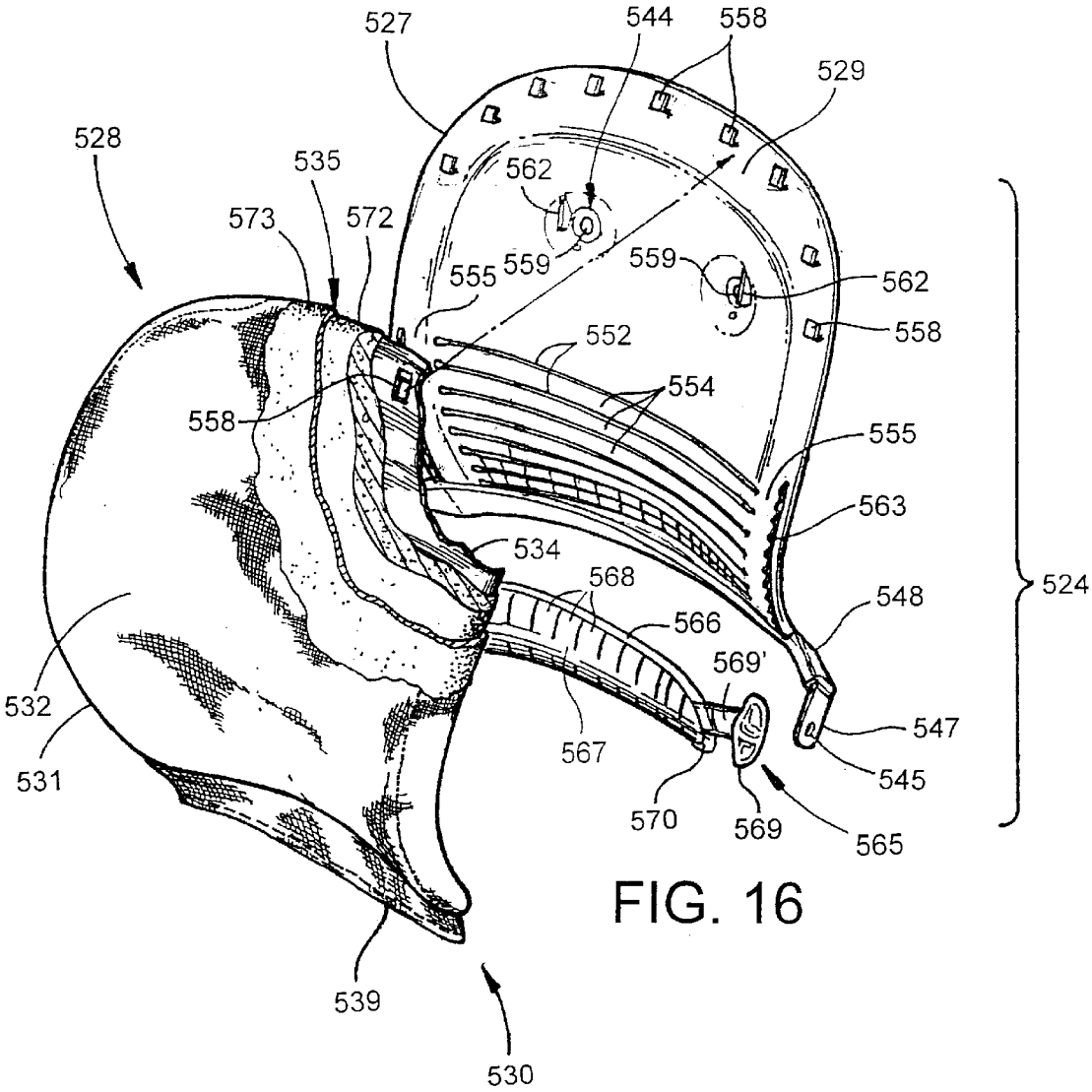
FIG. 16 is an exploded front perspective view of the back construction shown in FIG. 14.

The back support shell 527 (FIG. 17) comprises a sheet of polypropylene material or similar engineering-type stiff structural material, and includes relatively stiff thoracic and pelvic sections 541 and 542 connected by a flexible lumbar section 543. The back support shell 527 is relatively stiff in a plane defined by the sheet, but is flexible in the lumbar section 543 in a direction perpendicular to the sheet. The thoracic and pelvic sections 541 and 542 are attached to the back frame 522 at top and bottom pivot locations 544 and 545, and the lumbar section 543 protrudes forwardly from the thoracic and pelvic sections 541 and 542. A belt bracket 546 extends parallel a lower edge of the pelvic section 542, and includes forwardly extending side flanges 547 each having a hole defining the bottom pivot location 545. The belt bracket 546 is encapsulated in an enlarged section 548 that extends along the lower edge of the pelvic section 542, and forms a horizontal recess 549 defined between a longer rear lip 550 and a shorter front lip 551. Slots 552 extend horizontally across a center area of the lumbar section 544 to form horizontal bands 554, but terminate short of the edges of the lumbar section 544 to define vertical side edge bands 555 (FIG. 16). The horizontal and vertical bands 554 and 555 are semi-flexible and designed to be sufficient in size and strength to provide the support desired. Due to the locations of top and bottom pivot locations 544 and 545 and also due to the shape and characteristics of the sections 541-543 and belt bracket 546, the back support shell 527 flexes significantly in the lumbar area, but rotates along a predetermined path a substantial amount around the bottom pivot location 545 and to a lesser extent around the top pivot location 544. This results is significant wrinkling of the upholstery material, unless the back construction 524 is constructed to compensate and make up for this high flexure, and the high compressing and stretching of the surfaces (i.e., the upholstery) in the lumbar section 544.

Figure 19:
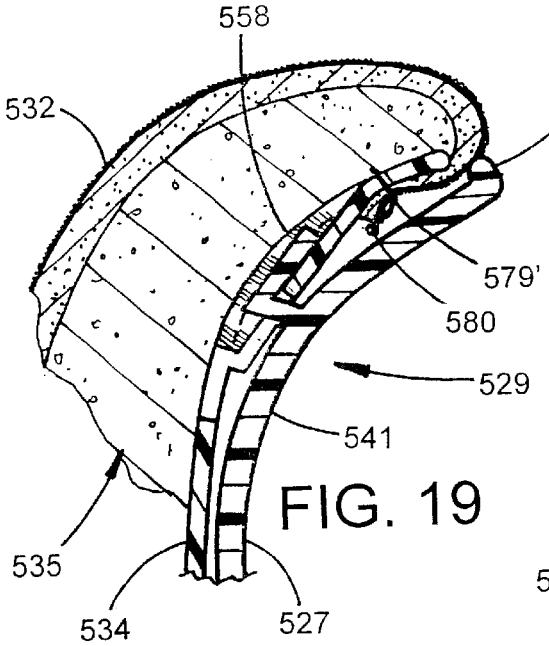
FIGS. 18–19 are enlarged views of the circled areas V and VI in FIG. 17.

The thoracic section 541 (FIG. 19) includes a ridge 557 along its upper edge and a series of hooks 558 spaced below the ridge 557 that project forwardly and then upwardly. A pair of apertures 559 is spaced below the hooks 558. The apertures 559 are positioned to receive screws 560 (FIG. 17) that extend rearwardly through the apertures 559 into threaded engagement with bosses 561 near a top of the arch-shaped back frame 522. The apertures 559 are recessed to create a rearwardly deformed pocket to receive a head of the screws 560 as desired. A pair of alignment stops 562 are located in the recesses on a front of the back support shell 527 adjacent apertures 559 to assist in assembly, as described below.

A pair of saw-tooth ridges 563 (FIG. 16) extends along a front face of the vertical bands 555 at a location near to but spaced inwardly from outer edges of the bands 555. A lumbar adjustment device 565 is positioned between the cushion assembly 528 and the back support shell 527. The lumbar adjustment device 565 includes a carrier 566, a lumbar support member 567 with vertical leaf-spring-like fingers 568 supported on the carrier 566, and a pair of side handles 569. The side handles 569 telescopically engage mating structures 570 on ends of the carrier 566, and further include a channel for slidably engaging the saw-tooth ridges 563. A resilient detent 569' on the handles 569 engages the saw-tooth ridges 563 to hold the lumbar adjustment device in a selected vertical position.

The cushion assembly 528 includes a back cushion 535 (FIG. 16) having a polyurethane foam main cushion 572 and a polyurethane foam topper cushion 573. The topper cushion 573 is added to provide a better initial support and feel to the assembly when a seated user initially leans against the cushion assembly 528. The cushion stiffener 534 comprises a stiff polypropylene panel. The main cushion 572 includes a rear surface shaped to mateably receive the cushion stiffener 534. An upper edge 574 (FIG. 20) on a rear surface of the main cushion 572 is wrapped over the upper edge 574 and onto a rear surface of the cushion stiffener 534. The cushion stiffener 534 is adhered to the main cushion 572 as needed to maintain the stability of the assembly desired. The cushion stiffener 534 includes a series of spaced-apart apertures 575 that correspond to the hooks 558 (FIG. 16). A horizontal down flange 576 (FIG. 20) extends along a lower edge of the cushion stiffener 534, which flange 576 is deformed inwardly toward the main cushion 572 at least a thickness of the material of rear panel 533, so that the rear panel 533 does not protrude outwardly when attached to the flange 576, as described below. The main cushion 572 has a recess 576' that mateably engages the flange 576.

As noted above, the cover assembly 531 (FIG. 21) includes a front panel 532 and a rear panel 533. The front panel 532 includes sections of upholstery material sewn together to form the front and sides of a covering for the cushion 535. The rear panel 533 includes the first fabric section 536, which comprises a material that stretches horizontally only about five percent (5%), but that stretches vertically about forty percent (40%). The one-directional stretch material is available in commerce, such as from Milliken Company, Spartanburg, South Carolina. This first fabric section 536 is sized to extend from the mid-level horizontal flange 576 on the cushion stiffener 534 downwardly to a bottom of the cushion 535. The second section 537 is a high-stretch material having a stretchability of about one hundred percent (100%). This second section 537 is about two inches high and extends across a bottom of the rear panel 533 of the cover assembly 531. A strip of stiffener material 578, such as polypropylene, is about ¼-inch wide in a vertical direction and is placed along a lower edge of the second section 537. The lower edge is folded over the strip 578 and sewn to the lower edge. This forms a stiffened edge flange 579 horizontally across the second section 537 that is optimally suited to be pressed or "zipped" into and frictionally retained in the horizontal recess 549 with a zip-lock like motion (see FIG. 18). Notably, the stiffened edge flange 579 is rectangular in shape and is rolled forwardly 180 degrees before it is inserted into the recess 549 (FIG. 18). This results in a surprisingly positive and secure bottom connection arrangement and one that can be quickly made by an assembler. The top rear edge of the front panel 532 (FIG. 19) is folded and sewn to form a perimeter path 579', and a drawstring 580 is located in the perimeter path. The front and rear panels 532 and 533 are sewn together to form an upwardly open sock. The panels 532 and 533 are initially sewn in an inverted position, and the cushion 535 is inserted into the sock as the sock in inverted. This also hides the seam lines where the panel 532 and first and second fabric sections 536 and 537 are sewn together.

Figure 22:
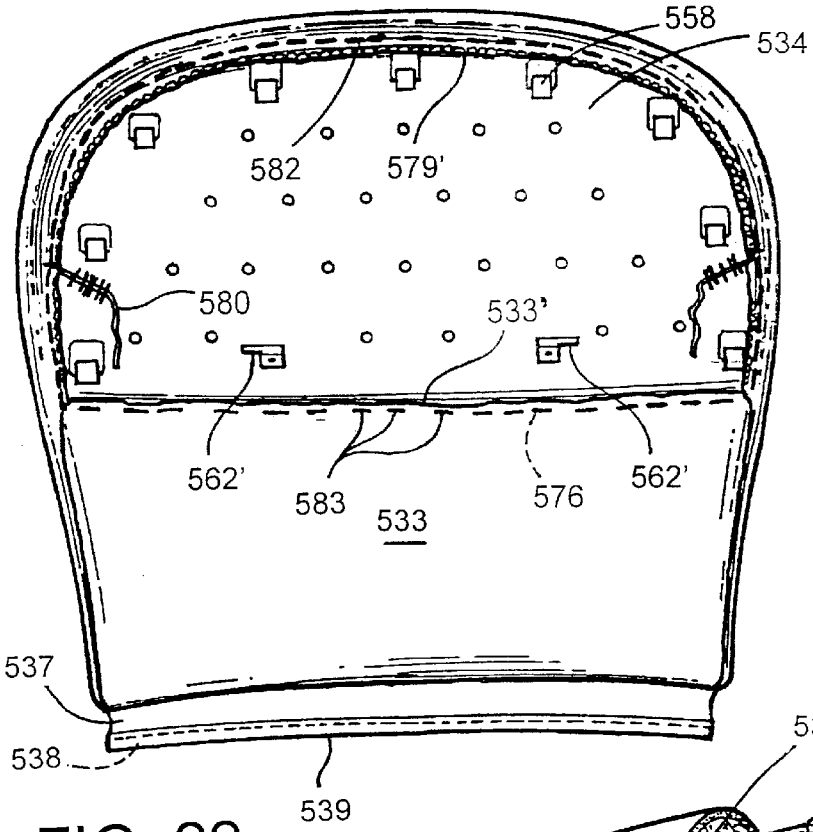
FIG. 22 is a rear view of the cushion assembly shown in FIG. 16, including the stiffened cushion subassembly and the cover assembly.
Figure 23:
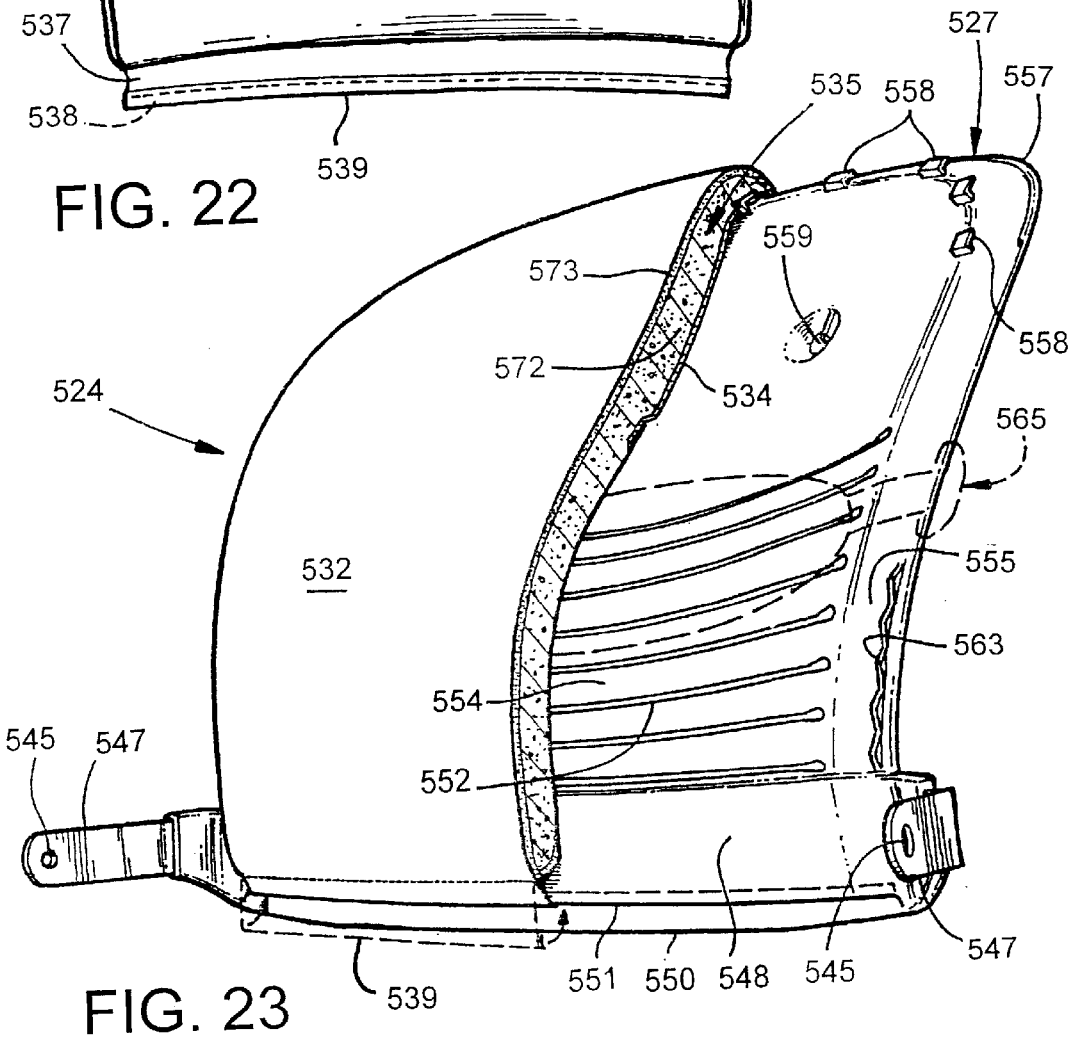
FIG. 23 is a front perspective view, partially broken away, showing the back construction of FIG. 16.
Figure 26:
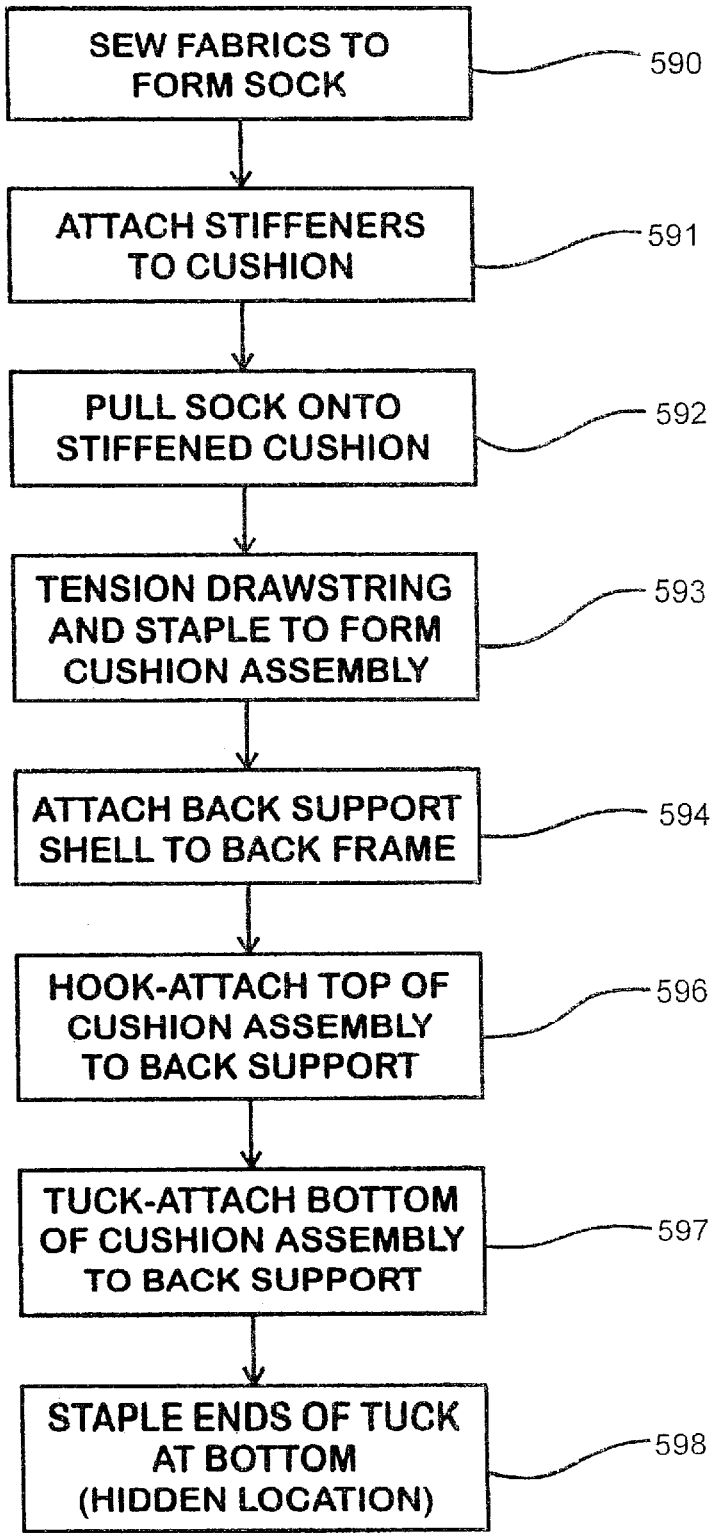
FIG. 26 is a flow diagram showing a method of assembly.

FIG. 26 discloses a method including forming a sock-like cover assembly 531 in a step 590 from the panels 532 and 533 and second fabric section 537. Step 590 further includes sewing a strip 578 to a bottom of second fabric section 537 and attaching a drawstring 580 in a tunnel 579'. A second step 591 includes attaching cushion stiffener 534 to the cushion 535. The cover assembly 531 is positioned adjacent the cushion 535 and inverted onto an end of the cushion 535 opposite the cushion stiffener 534 in a step 592. This results in the high-stretch second fabric section 537 being positioned at a lower edge of the cover assembly 531 remote from the cushion stiffener 534. The cover assembly 531 is then adjusted on the cushion 535 and cushion stiffener 534 to eliminate wrinkles and to properly position the seam lines. This may include tensioning the drawstring 580, as shown in step 593. Specifically, in the illustrated embodiment, the drawstring 580 is tensioned to draw a top of the cover assembly 531 downwardly onto the cushion stiffener 534. This also tensions the front panel 532. The tensioned drawstring 580 helps hold the cover assembly 531 in position during the steps of inserting staples 582 and 583, and during a step of setting any adhesive in the assembly. The front panel 532 is then staple-attached along its upper edge to the cushion stiffener 534 by staples 582 (FIG. 22) that extend through the wrapped-over top edge of the front panel 532 into the cushion stiffener 534. The upper edge 533' of the rear panel 533 is overlapped onto the down flange 576 and is stapled with staples 583 that extend through the upper edge into the down flange 576. Where desired, heat-activated adhesive is applied to a front surface of the topper cushion 573, and the adhesive is activated by steam or heat to adhere the front panel 532 to the topper cushion 573. This assembly results in cushion assembly 528.

The back support shell 527 of the back construction 524 (FIG. 26) is attached in a step 94 to the back frame 522 by screws 560 at the top connection 544 and by pivot studs at the bottom connection 545. A lumbar force adjusting device 595 (FIG. 15) is attached to the back frame 522 to bias the flange 547 of belt bracket 546, such that the lumbar section 543 of the back support shell 527 naturally is biased to a forwardly concave shape.

The cushion assembly 528 is assembled onto the back support shell 527 in a step 596 (FIG. 26) to form the back construction 524 by abutting stops 562' on the cushion stiffener 534 against the stops 562' on the back support shell 527, and by extending the hooks 558 on the thoracic section 541 of the back support shell 527 into the apertures 575 of the cushion stiffener 534. Then, the back cushion 535 including the cushion stiffener 534 is moved downwardly to frictionally engage the hooks 558. Thereafter, the stiffened edge flange 539 at the bottom of the rear panel 533 is stretched, rolled 180 degrees, and tucked upwardly into the downwardly facing horizontal recess 549 on the back support shell 527 (in a step 597). The stiffened edge flange 539 is tucked into position from one side to another with a zip-lock type motion. After it is fully inserted, the side edges of the high-stretch second section 537 are pulled back, and a staple is extended through the stiffened edge flange 539 into each end of the rear lip 550 in a step 598. The high-stretch second section 537 is then pulled laterally out to a wrinkle-free condition where it hides these end-located staples. Notably, the high-stretch second section 537 is a dark or black color and is located behind the seat 523 below the back construction 524 in the shadow of the back construction 524, such that the bottom connection 530 including the enlarged section 548 of the back support shell 527 is not easily visible to a person standing in or around the chair 520.

Figure 24:
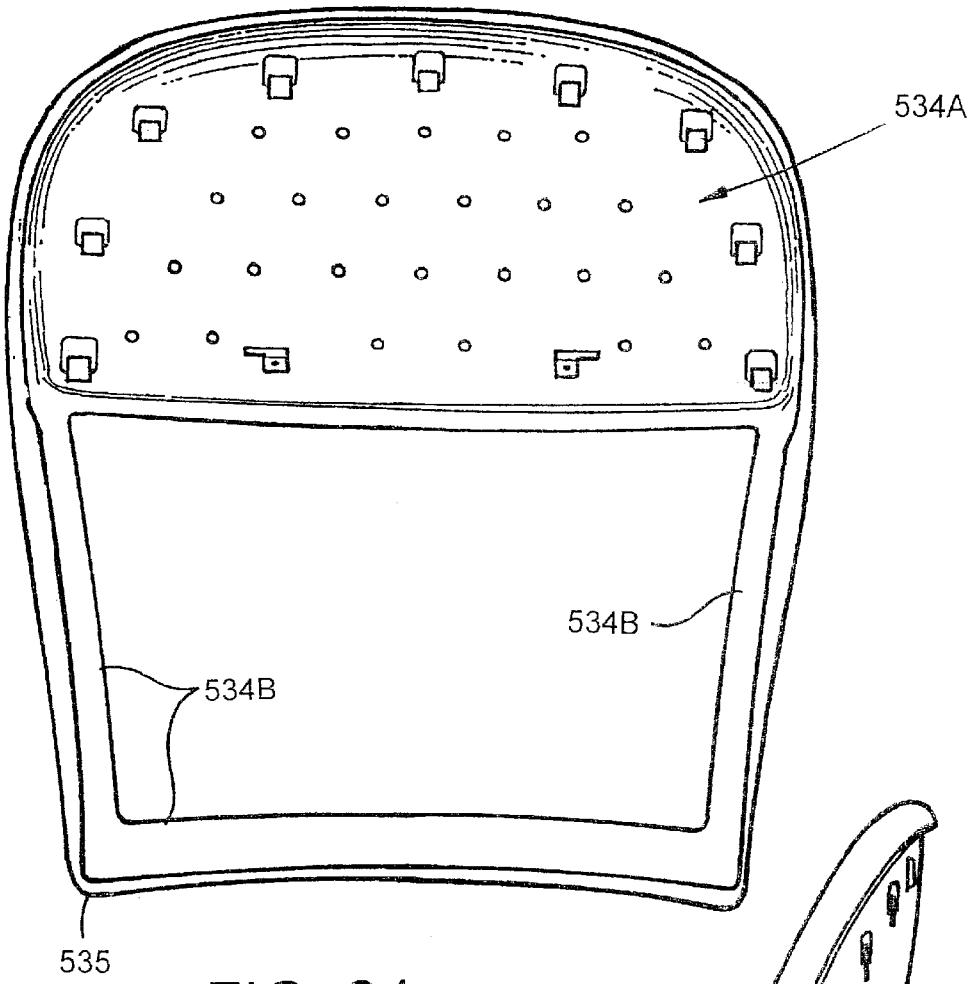
FIG. 24 is a rear view of a modified cushion assembly similar to that shown in FIG. 22, but with edge stiffener legs extending downwardly along side edges of the cushion pad.
Figure 25:
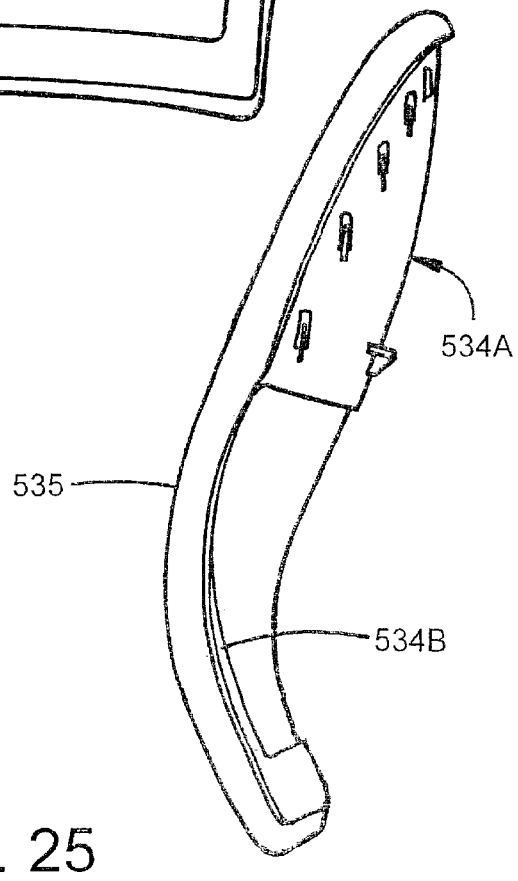
FIG. 25 is a side view of the modified cushion assembly shown in FIG. 24.

In the embodiment of FIGS. 24–25, a modified cushion stiffener 534A is provided that includes an upper portion like the stiffener 534, but further includes perimeter bands 534B that extend down side edges and along a bottom of the cushion 535 to stiffen the edges completely around the cushion 535. Cushion stiffener 534A is desirable where the fabric panels 532 or 533 are so strong as to overpower the cushion edges causing wrinkling.

SECOND MODIFICATION

Figure 27:
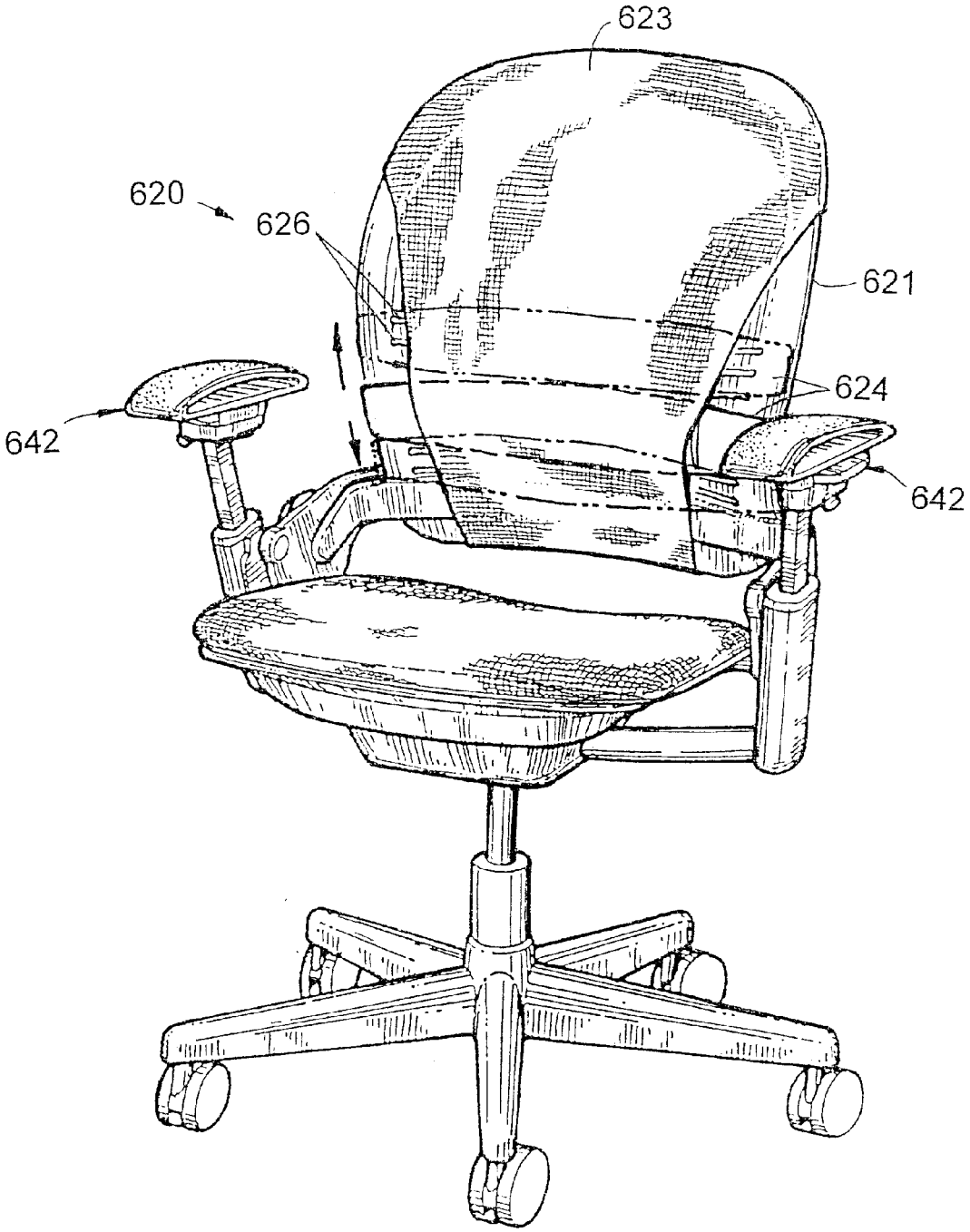
FIG. 27 is a front perspective view showing a chair incorporating the present lumbar adjustment device.
Figure 28:
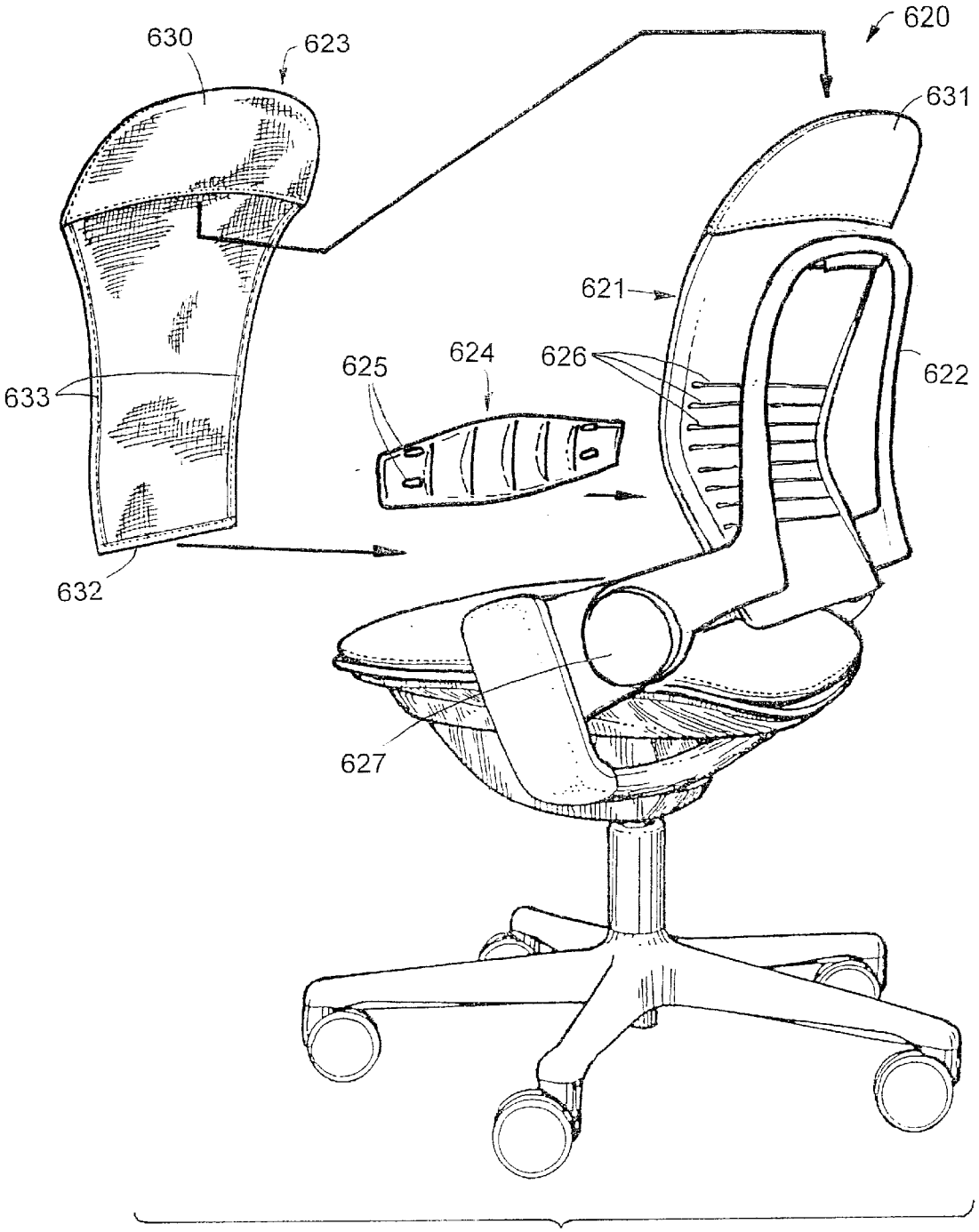
FIG. 28 is a rear exploded perspective view showing the chair of FIG. 27.
Figure 29:
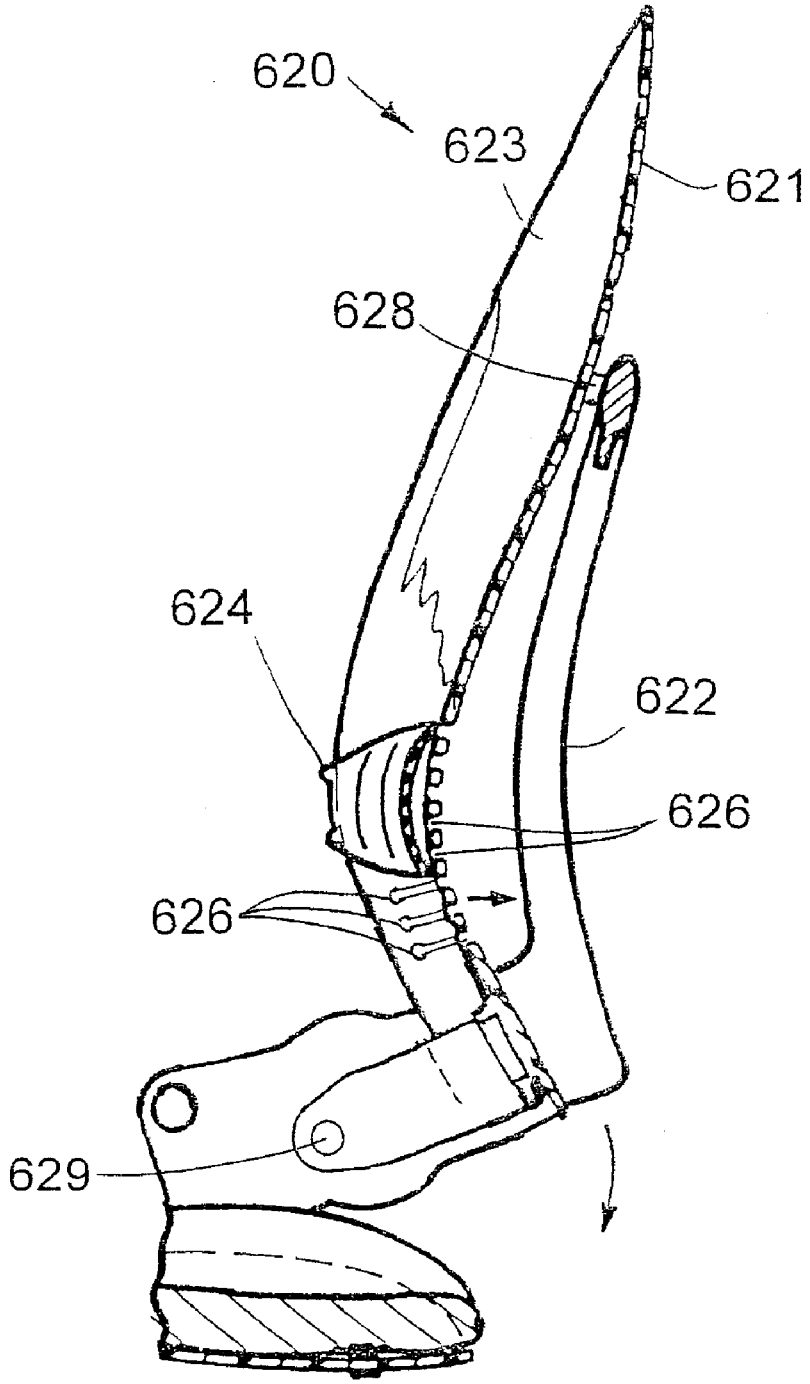
FIG. 29 is a vertical cross section taken centrally through FIG. 27.

A chair 620 (FIG. 27) includes a flexible back shell 621 operably supported on an arching back frame 622 (FIG. 28) for both lateral and vertical flexure. A back covering 623 covers most of a front surface of the back shell 621, and an adjustable lumbar device 624 is positioned between the back shell 621 and the back covering 623. The back covering 623 is tensioned from top to bottom and the lumbar device 624 has a friction-generating surface, such that the adjustable lumbar device 624 is frictionally retained between the back shell 621 and the back covering 623. As illustrated, the lumbar device 624 further includes protrusions 625 for detentingly engaging slots 626 in a lumbar area of the back shell 621. The adjustable lumbar device 624 is preferably relatively flimsy and bendable so that the lumbar device 624 will flex to conform to a horizontal shape of the chair back shell 621, but is relatively stiff in a direction perpendicular to a front surface of the back shell 621, so that the lumbar device 624 maintains its crescent-shaped cross section (see FIG. 29) and provides good lumbar support to a seated user.

The back shell 621 (FIG. 27) is made of relatively flexible material, and further includes slots 626 in a lumbar area of the chair, causing the lumbar area to be even more flexible. The side edges of the back shell 621 (FIG. 27) are non-parallel and form an inwardly tapered bottom section of the back shell 621.

The back frame 622 (FIG. 29) is pivotally connected to the back shell 621 at top and bottom pivots 628 and 629. The top and bottom pivots 628 and 629 permit the back shell to flex in a controlled manner in the lumbar area of the back shell 621 as a seated user flexes their lower back and spine. The back shell 621 is biased to a forwardly convex shape by a lumbar biasing device 627 (FIG. 28) at bottom pivot 629 (FIG. 29) for optimal lumbar support.

A covering 623 (sometimes referred to as a "vest") (FIG. 28) includes a sock-like top section 630 that slips over and engages a top section 631 of the back shell 621. A bottom edge 632 of the covering 623 includes a stiff strip that frictionally engages a groove along a lower edge of the back shell 621 with a zip-lock-like action. The edges 633 of the illustrated covering 623 are cut at an angle and extend diagonally inwardly from top to bottom in a manner exposing ends of the slots 626. This highlights the lumbar area of the back shell 621, and helps give the chair 620 a modern and "high tech" appearance. The covering 623 is made of a stretchable material, and is tensioned when installed, such that the covering 623 is at all times drawn tight across a front surface of the back shell 621 without wrinkles, despite flexure of the lumbar region of the back shell 621.

Figure 30:
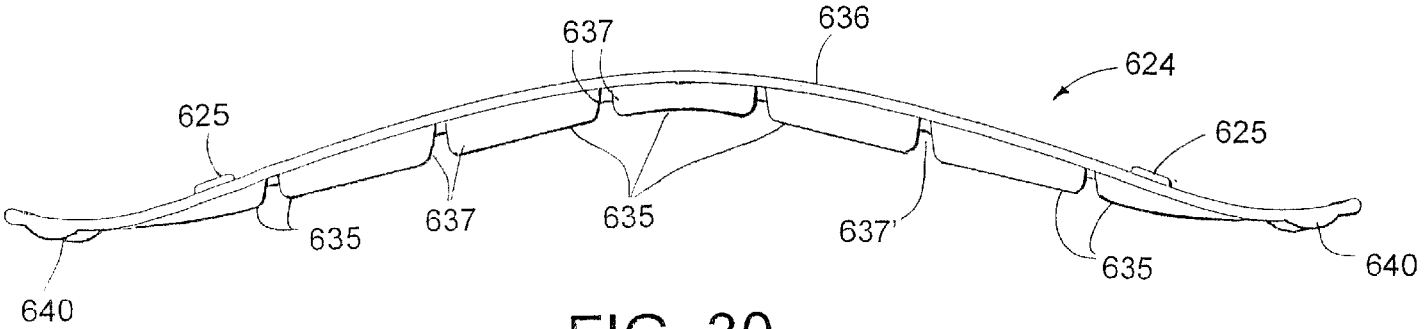
FIGS. 30–32 are top, front and side views of the lumbar device shown in FIG. 27.
Figure 31:
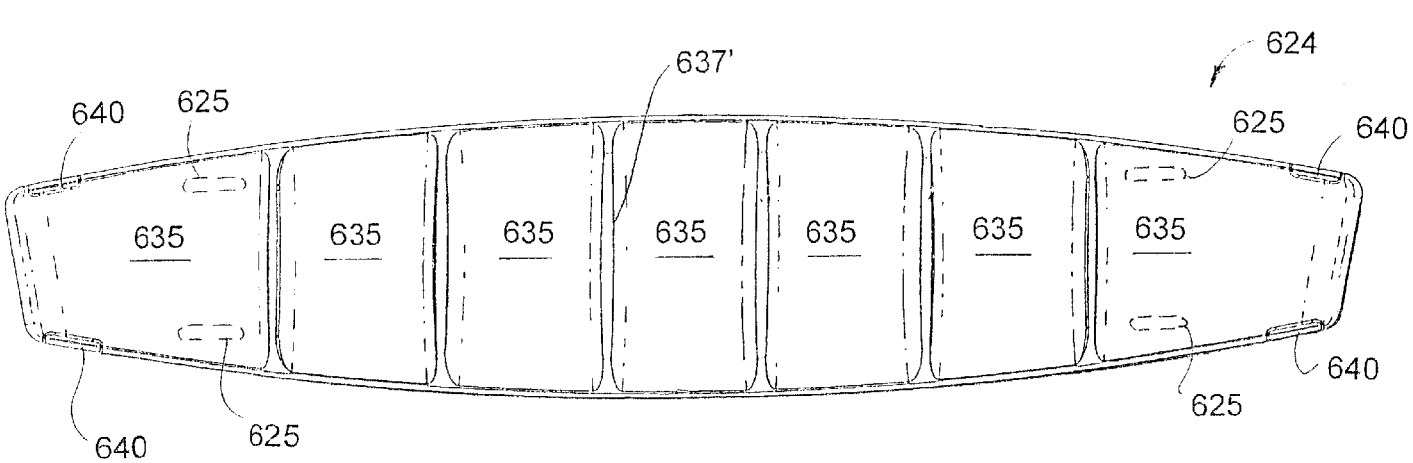
Figure 32:
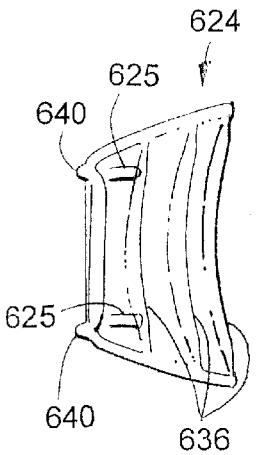

The lumbar device 624 (FIGS. 30–32) includes front wall sections 635, rear wall sections 636, and transverse wall sections 637. The rear wall sections 636 combine to form a rear surface that lies relatively flat against the front surface of the back shell 621 in the lumbar area of the back shell 621.

Due to the coefficient of friction generated by the rubber-like material of the lumbar device 624 against the back shell 621, the lumbar device 624 tends to stay in an adjusted position. Nonetheless, protrusions 625 are optionally included that extend from the back surface for engaging the slots 626 in the back shell 621. Pairs of the protrusions 625 can be spaced vertically apart on each end section of the lumbar device 624, thus creating a rectangular matrix that tends to orient the lumbar device as the protrusions 625 engage the slots 626. The transverse wall sections 637 are crescent-shaped, and form channels or ribs 637' that extend vertically on the lumbar device 624 to stiffen the lumbar device 624 in a way so that the forward wall sections 635 maintain their forwardly convex shape even when the lumbar device 624 is leaned on by a seated user.

The transverse wall sections 637 provide stiffening in a plane that extends vertically and forwardly/rearwardly on the chair. However, the lumbar device 624 is made from a relatively flexible material, such as a polyurethane elastomer made by Dow Chemical Company called PELLETHANE™. The optimal material has a Shore A durometer hardness of 83A, and is rubber-like with a surface that (when newly molded) is almost tacky. This provides a strong holding force when the lumbar device 624 is squeezed between the back shell 621 and the back covering 623. The particular preferred material of the lumbar device 624 has a flexural modulus that is so low that its flexural modulus under ASTM D790 is not given on the material specification sheet provided by the manufacturer. (The flexural modulus is believed to be below 11,000 psi since the flexural modulus of other variations of similar materials are given on the specification sheet.) The preferred material forms a lumbar device that is surprisingly and unexpectedly weak and bendable. For example, if one end of the lumbar section 624 is grasp and held in a horizontal orientation, the rest of the lumbar device 624 droops to a vertical position. This allows the lumbar device 624 to conform to the side-to-side shape of the lumbar area of the back shell 621, and further allows the lumbar device 624 to flex and follow the changing shape of the back shell 621 as a person leans and twists in the chair 620, such as during recline or when reaching toward one side of the chair. The vertical ribs 637' provide good strength to maintain the C-shaped vertical cross-section of the part, as noted above. The material of the lumbar device preferably has excellent abrasion resistance, good low temperature flexibility, good impact resistance, good resistance to non-polar solvents, a high compressive strength, and easy proccessability.

The preferred material of the lumbar device 624 is transparent or translucent. This provides a very distinctive modernistic look. Advantageously, the transparency of the material allows a user to see through the lumbar device 624 sufficiently to see the slots engaged by the protrusions 625. This allows a user to easily see exactly how the lumbar device 624 is adjusted before sitting in the chair 620. The vest or covering 623 also allows some see-through to allow a user to see the lumbar device 624 through the fabric. This also provides a distinctive attractive appearance, and also helps a user identify an adjusted position of the lumbar device 624. Notably, a combination of the clear lumbar device 624 and the clear top covering on the armrests 642 provides a very attractive and high-tech appearance.

The end sections of the lumbar device 624 (FIGS. 30–32) include forwardly extending tabs 640, one tab being on the top and one on the bottom of each end section. The tabs 640 extend forwardly sufficiently to act as handles for grasping by a user. Notably, the tabs 640 are only long enough to provide a stub that can be gripped by fingers, but not "too long". A reason is because in the highest adjusted position of the lumbar device 624, the top tab 640 may actually slip under the covering 623.

Figure 33:
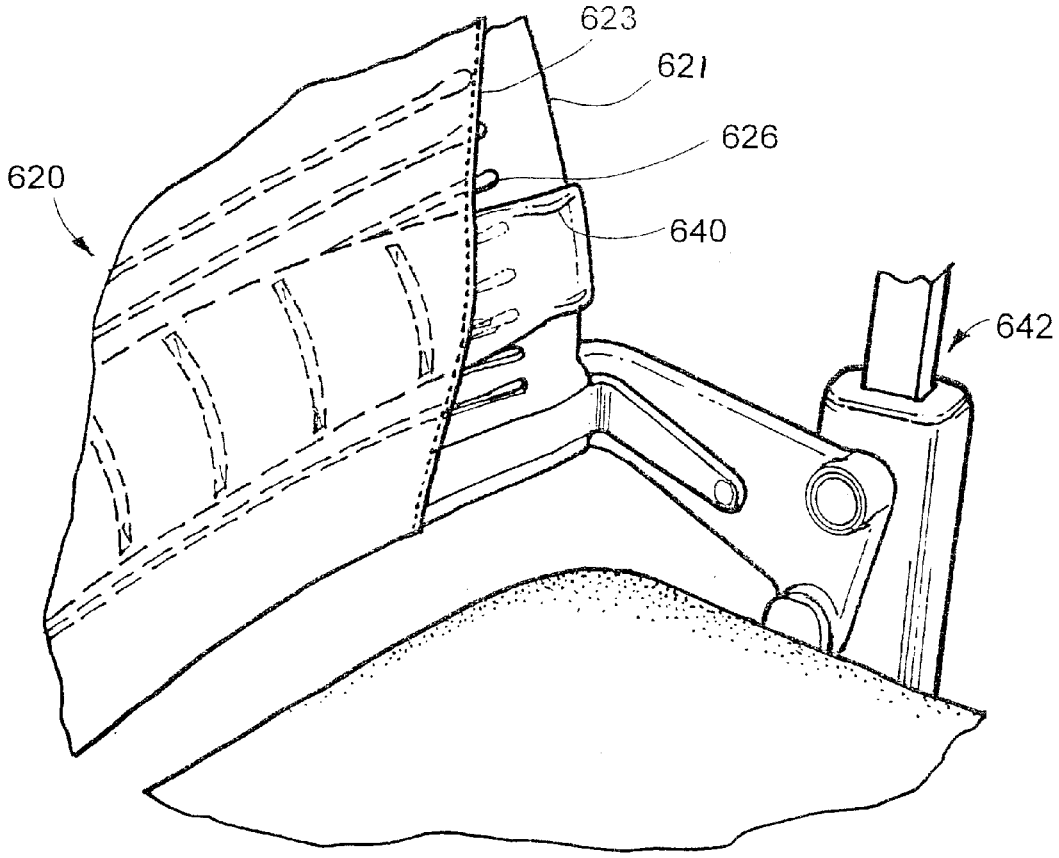
FIG. 33 is an enlarged, fragmentary perspective view of FIG. 27.
Figure 34:
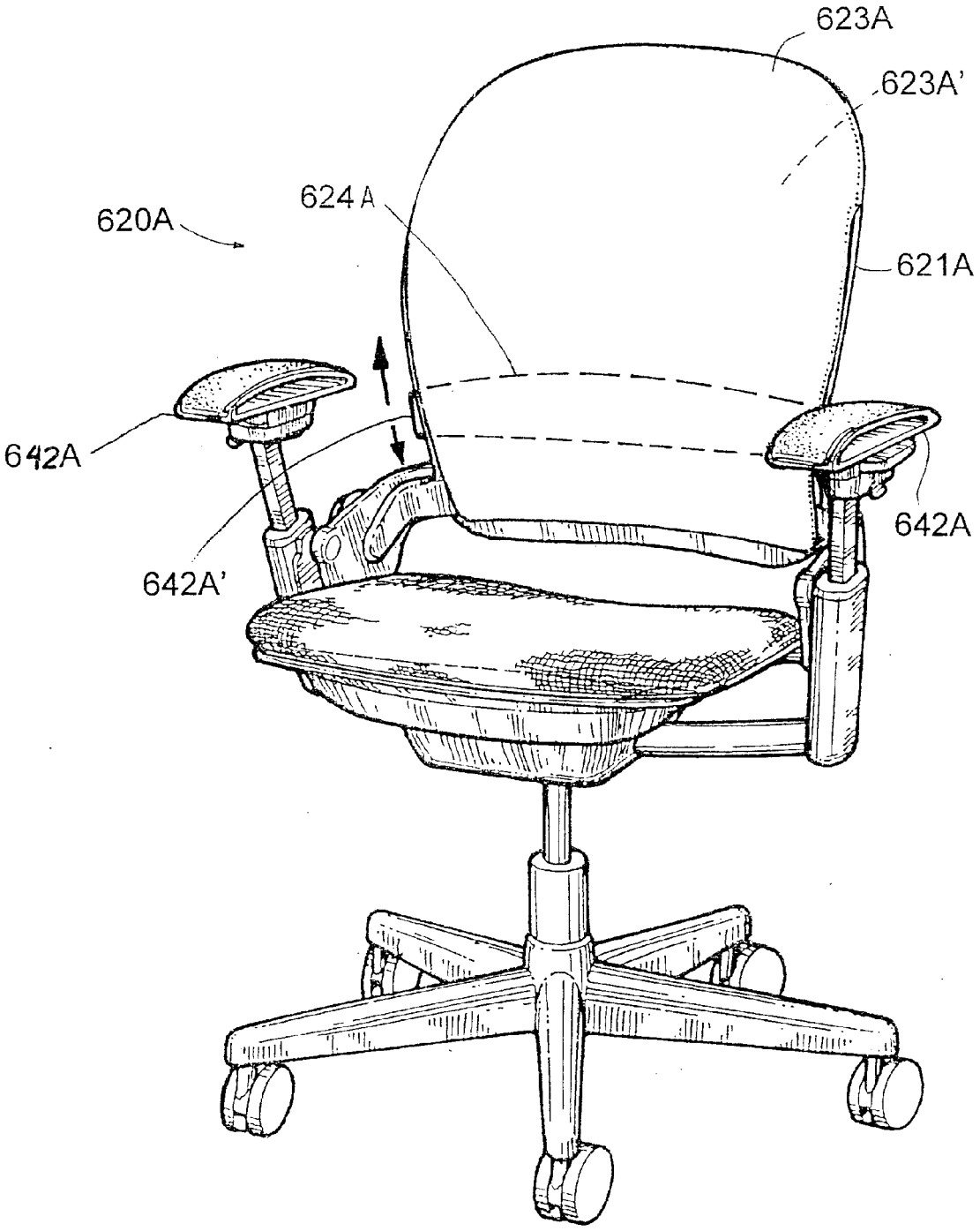
FIG. 34 is a front view of a modified chair similar to FIG. 27 but including a chair having a cushion assembly covering a front surface of its back.

A second embodiment of the chair 620A (FIG. 33) includes many features and components that are identical or similar to the chair 620. To reduce redundant discussion, the components and features of chair 620A that are similar to chair 620 are referred to by the same identification number, but with the addition of a letter "A". The covering 623A is an assembly that includes fabric sewn around a cushion 623A'. The edges of the covering 623A extend to and follow the edges of the back shell 621A. The end sections 624A' of the lumbar device 624A extend to locations just outboard of the edges of the back shell 621A when the lumbar device 624A is positioned in its highest adjusted position. In the lowest adjusted position, the end sections of the lumbar device 624A extend significantly outboard of the edges of the back shell 621A, since the edges of the back shell 621A are tapered inwardly near their bottom portions. Nonetheless, the transparency of the end sections reduces their visibility/noticeability, and the transparency creates a novel high tech appearance that is desirable in the chair 620A.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A seating unit comprising:

a flexible back having a front surface and including a non-planar flexible lumbar region;

a tensioned cover stretched over and covering at least a portion of the non-planar flexible lumbar region; and a lumbar device fit between the front surface and the cover, with a tension of the cover biasing the lumbar device against the lumbar region and resulting in a frictional force retaining the lumbar device in a selected vertical position.

2. The seating unit defined in claim 1, wherein the lumbar device includes a first surface engaging a front of the lumbar region and further includes a second surface engaging a back of the cover, the second surface being more concavely shaped than the first surface.

3. The seating unit defined in claim 1, wherein the flexible back characteristically does not include a ridge defining a track.

4. The seating unit defined in claim 1, wherein the lumbar device includes detents shaped to detentingly engage mating features in the lumbar region.

5. The seating unit defined in claim 4, wherein the mating features include horizontally extending slots in the lumbar region.

6. The seating unit defined in claim 1, wherein the lumbar device is one-piece and includes handles integrally formed on ends of the lumbar device.

7. The seating unit defined in claim 1, wherein the cover includes angled side edges, and wherein the portion covered by the cover does not include edge sections of the back.

8. The seating unit defined in claim 1, wherein the cover includes a front panel covering the portion of the lumbar region, the front panel being made from stretchable material that is sufficiently elastic to tension the cover even when the lumbar region is flexed toward a planar condition.

9. The seating unit defined in claim 1, wherein the cover includes a strip of material having an elongation elasticity of 100%, such that a length of the strip can be doubled without failure.

10. The seating unit defined in claim 1, wherein the lumbar device comprises an integral one-piece plastic component.

11. The seating unit defined in claim 10, wherein the one piece plastic component of the lumbar device is highly flexible and includes sufficient strength to maintain a concave vertical shape but does not include sufficient strength to maintain a longitudinal shape against the force of gravity.

12. The seating unit defined in claim 10, wherein the one piece plastic component is made of a light-transmissive material.

13. The seating unit defined in claim 1, wherein the lumbar device includes end sections that are made of light-transmissive material.

14. The seating unit defined in claim 13, wherein the light-transmissive material is translucent.

15. The seating unit defined in claim 1, wherein the back includes at least one vertically-extending track located proximate at least one side edge of the back.

16. The seating unit defined in claim 15, wherein the at least one track is located at and defines the side edge of the back.

17. The seating unit defined in claim 15, wherein the lumbar device includes at least one handle that slidingly engages the at least one track.

18. The seating unit defined in claim 17, wherein the lumbar device includes a center body, and the at least one handle telescopically slidingly engages the center body for inboard and outboard movement as the lumbar device is adjusted vertically on the back.

19. The seating unit defined in claim 18, wherein the lumbar device includes a slide frame and also includes a flexible lumbar support component that is mounted on the slide frame.

20. The seating unit defined in claim 19, wherein the flexible lunber support component comprises a resilient sheet-simulating panel.

21. The seating unit defined in claim 20, wherein the sheet-simulating panel includes resilient fingers along edges of the panel.

22. The seating unit defined in claim 1, wherein the back includes a vertically-extending track having a saw-tooth-shaped surface forming detents on the track.

23. The seating unit defined in claim 22, wherein the track is located proximate a side edge of the back.

24. The seating unit defined in claim 23, wherein the track is spaced inboard from the side edge of the back.

25. The seating unit defined in claim 24, wherein the lumbar device includes at least one handle that detentingly engages the saw-tooth-shaped track.

26. The seating unit defined in claim 1, wherein the back includes a flexible molded back shell.

27. The seating unit defined in claim 26, wherein the back shell comprises a plastic sheet that characteristically does not have an edge flange and ribs in the lumbar region for rigidifying and stiffening the lumbar region.

28. The seating unit defined in claim 1, wherein the back includes a flexible sheet having vertical strips at each side edge of the lumbar region and further the lumbar region has horizontal strips separated by horizontal slots that extend transversely and end at the vertical strips, the lumbar device including radiused surfaces shaped to slip over the slots during vertical adjustment of the lumbar device.

29. The seating unit defined in claim 28, wherein the radiused surfaces detentingly engage the slots to provide holding forces to hold the lumbar device in selected positions.

30. The seating unit defined in claim 1, wherein the lumbar region is concavely shaped and protrudes forwardly.

31. A back for a seating unit comprising:

a flexible back shell having a front surface and including a non-planar flexible lumbar region;

a cover covering at least a portion of the non-planar flexible lumbar region; and a lumbar device fit between the front surface and the cover, the lumbar device being vertically adjustable and being made of a material chosen to generate friction with the lumbar region and with the cover to retain the lumbar device in a selected vertical position.

32. The back defined in claim 31, wherein the material of the lumbar device is sufficiently stiff to change the shape of the lumbar region as the lumbar device is adjusted vertically, but that is sufficiently flexible to conform to side-to-side shapes of the back as a seated user moves and twists in the seating unit.

33. The back defined in claim 31, wherein the lumbar device has a front surface that is concavely shaped and that has a greater concavity than a rear surface of the lumbar device.

34. A method comprising steps of:

providing a flexible back having a front surface and including a non-planar lumbar region of a seating unit;

providing a cover shaped to cover at least a portion of the lumbar region;

tensioning the cover;

providing a lumbar device; and fitting the lumbar device between the front surface and the cover, with a tension of the cover biasing the lumbar device against the lumbar region and resulting in a frictional force retaining the lumbar device in a selected vertical position.

35. The method defined in claim 34, wherein the flexible back includes a flexible sheet of plastic that characteristically does not include edge flanges nor ribs that rigidify and stiffen the lumbar region.

36. The method defined in claim 34, wherein the cover is removable and is attached without the use of separate fasteners, and including a step of removing the cover.

37. The method defined in claim 34, wherein the lumbar device is removable and is attached without the use of separate fasteners, and including a step of removing the lumbar device.

38. The method defined in claim 34, wherein the lumbar region is concavely shaped and protrudes forwardly.

39. A method comprising steps of:

providing a seating unit having a back support with a front surface;

covering at least a portion of the front surface with a sheet back covering;

positioning a lumbar device between the front surface of the back support and a portion of the back covering; and vertically adjusting the lumbar device to a selected height and holding the lumbar device in place with friction between the back support and the back covering.

40. The method defined in claim 39, wherein the back support has a lumbar region with horizontal slots formed therein, and wherein the lumbar device is shaped to frictionally engage a selected one of the slots to provide a detented force for holding the lumbar device in an adjusted vertical position associated with the selected one slot, and including a step of adjusting the lumbar device to engage the selected one slot.

41. The method defined in claim 39, wherein the back support includes a flexible lumbar region that is concavely shaped, and wherein the step of vertically adjusting the lumbar device flexes the lumbar region and changes a vertical shape of the lumbar region.

* * * * *